US005672249A

United States Patent [19]

Vinson et al.

[11] Patent Number: 5,672,249

[45] Date of Patent: Sep. 30, 1997

[54] PROCESS FOR INCLUDING A FINE PARTICULATE FILLER INTO TISSUE PAPER USING STARCH

[75] Inventors: Kenneth Douglas Vinson; John Paul Erspamer; Charles William Neal, all of Cincinnati, Ohio; Jonathan Andrew Ficke, Lawrenceburg, Ind.; Jeffress Paul Halter, Jackson, Tenn.

[73] Assignee: The Procter & Gamble Company, Cincinnati, Ohio

[21] Appl. No.: 627,157

[22] Filed: Apr. 3, 1996

[51] Int. Cl.[6] ..... D21H 17/69

[52] U.S. Cl. ..... 162/111; 162/112; 162/113; 162/125; 162/127; 162/128; 162/129; 162/130; 162/175; 162/181.1; 162/181.2; 162/181.3; 162/181.4; 162/181.5; 162/181.6; 162/18.8; 162/183

[58] Field of Search ..... 162/111, 112, 162/113, 181.6, 181.8, 181.1, 183, 175, 125, 127, 128, 129, 130, 181.2, 181.3, 181.4, 181.5

[56] References Cited

U.S. PATENT DOCUMENTS

| | | | |
|---|---|---|---|
| 2,216,143 | 10/1940 | Thiele et al. | 92/40 |
| 3,293,114 | 12/1966 | Kenaga et al. | 162/168 |
| 3,301,746 | 1/1967 | Sanford et al. | 162/113 |
| 3,821,068 | 6/1974 | Shaw | 162/111 |
| 3,823,062 | 7/1974 | Ward et al. | 162/123 |
| 3,974,025 | 8/1976 | Ayers | 162/113 |
| 3,994,771 | 11/1976 | Morgan, Jr. et al. | 162/113 |
| 4,166,001 | 8/1979 | Dunning et al. | 162/111 |
| 4,191,609 | 3/1980 | Trokhan | 162/113 |
| 4,210,490 | 7/1980 | Taylor | 162/175 |
| 4,295,933 | 10/1981 | Smith | 162/168 |
| 4,300,981 | 11/1981 | Carstens | 162/109 |
| 4,308,092 | 12/1981 | Latimer et al. | 162/111 |
| 4,406,737 | 9/1983 | Latimer et al. | 162/111 |
| 4,529,480 | 7/1985 | Trokhan | 162/109 |
| 4,619,734 | 10/1986 | Anderson | 162/111 |
| 4,637,859 | 1/1987 | Trokhan | 162/109 |
| 4,753,710 | 6/1988 | Langley et al. | 162/164.3 |
| 4,772,332 | 9/1988 | Nemeh et al. | 106/487 |
| 4,795,530 | 1/1989 | Soerens et al. | 162/111 |
| 4,925,530 | 5/1990 | Sinclair et al. | 162/164.1 |
| 4,927,498 | 5/1990 | Rushmere | 162/168.3 |
| 4,940,513 | 7/1990 | Spendel | 162/112 |
| 4,943,349 | 7/1990 | Gomez | 162/158 |
| 4,954,220 | 9/1990 | Rushmere | 162/168.3 |
| 4,959,125 | 9/1990 | Spendel | 162/158 |
| 4,978,396 | 12/1990 | Story | 106/436 |
| 5,017,268 | 5/1991 | Clitherow et al. | 162/146 |
| 5,068,276 | 11/1991 | Suitch et al. | 524/413 |
| 5,127,994 | 7/1992 | Johansson | 162/168.3 |
| 5,164,045 | 11/1992 | Awofeso et al. | 162/101 |
| 5,164,046 | 11/1992 | Ampulski et al. | 162/111 |
| 5,185,206 | 2/1993 | Rushmere | 428/403 |
| 5,227,023 | 7/1993 | Pounder et al. | 162/101 |
| 5,228,954 | 7/1993 | Vinson et al. | 162/100 |
| 5,266,622 | 11/1993 | Mazanek et al. | 524/131 |
| 5,405,499 | 4/1995 | Vinson | 162/100 |
| 5,415,740 | 5/1995 | Schuster et al. | 162/168.3 |
| 5,487,813 | 1/1996 | Vinson et al. | 162/111 |

FOREIGN PATENT DOCUMENTS

| | | |
|---|---|---|
| WO8605530 | 9/1986 | France . |
| 62-184197 | 8/1987 | Japan . |

*Primary Examiner*—Peter Chin

*Attorney, Agent, or Firm*—Bart S. Hersko; E. Kelly Linman; Jacobus C. Rasser

[57] ABSTRACT

A process for incorporating a fine particulate filler such as kaolin clay into tissue paper is disclosed. The process results in strong, soft, and low dusting tissue paper webs useful in the manufacture of soft, absorbent sanitary products such as bath tissue, facial tissue, and absorbent towels.

22 Claims, 2 Drawing Sheets

PROCESS FOR INCLUDING A FINE PARTICULATE FILLER INTO TISSUE PAPER USING STARCH

TECHNICAL FIELD

This invention relates, in general, to creped tissue paper products and processes. More specifically, it relates to a process for incorporating a fine particulate filler into creped tissue paper products.

BACKGROUND OF THE INVENTION

Sanitary paper tissue products are widely used. Such items are commercially offered in formats tailored for a variety of uses such as facial tissues, toilet tissues and absorbent towels. The formats, i.e. basis weight, thickness, strength, sheet size, dispensing medium, etc. of these products often differ widely, but they are linked by the common process by which they originate, the so-called creped papermaking process.

Creping is a means of mechanically compacting paper in the machine direction. The result is an increase in basis weight (mass per unit area) as well as dramatic changes in many physical properties, particularly when measured in the machine direction. Creping is generally accomplished with a flexible blade, a so-called doctor blade, against a Yankee dryer in an on machine operation.

A Yankee dryer is a large diameter, generally 8–20 foot drum which is designed to be pressurized with steam to provide a hot surface for completing the drying of papermaking webs at the end of the papermaking process. The paper web which is first formed on a foraminous forming carrier, such as a Fourdrinier wire, where it is freed of the copious water needed to disperse the fibrous slurry is generally transferred to a felt or fabric in a so-called press section where de-watering is continued either by mechanically compacting the paper or by some other de-watering method such as through-drying with hot air, before finally being transferred in the semi-dry condition to the surface of the Yankee for the drying to be completed.

The various creped tissue paper products are further linked by common consumer demand for a generally conflicting set of physical properties: A pleasing tactile impression, i.e. softness while, at the same time having a high strength and a resistance to linting and dusting.

Softness is the tactile sensation perceived by the consumer as he/she holds a particular product, rubs it across his/her skin, or crumples it within his/her hand. This tactile sensation is provided by a combination of several physical properties. One of the most important physical properties related to softness is generally considered by those skilled in the art to be the stiffness of the paper web from which the product is made. Stiffness, in turn, is usually considered to be directly dependent on the strength of the web.

Strength is the ability of the product, and its constituent webs, to maintain physical integrity and to resist tearing, bursting, and shredding under use conditions.

Linting and dusting refers to the tendency of a web to release unbound or loosely bound fibers or particulate fillers during handling or use.

Creped tissue papers are generally comprised essentially of papermaking fibers. Small amounts of chemical functional agents such as wet strength or dry strength binders, retention aids, surfactants, size, chemical softeners, crepe facilitating compositions are frequently included but these are typically only used in minor amounts. The papermaking fibers most frequently used in creped tissue papers are virgin chemical wood pulps.

As the world's supply of natural resources comes under increasing economic and environmental scrutiny, pressure is mounting to reduce consumption of forest products such as virgin chemical wood pulps in products such as sanitary tissues. One way to extend a given supply of wood pulp without sacrificing product mass is to replace virgin chemical pulp fibers with high yield fibers such as mechanical or chemi-mechanical pulps or to use fibers which have been recycled. Unfortunately, comparatively severe deterioration in performance usually accompanies such changes. Such fibers are prone to have a high coarseness and this contributes to the loss of the velvety feel which is imparted by prime fibers selected because of their flaccidness. In the case of the mechanical or chemi-mechanical liberated fiber, high coarseness is due to the retention of the non-cellulosic components of the original wood substance, such components including lignin and so-called hemicelluloses. This makes each fiber weigh more without increasing its length. Recycled paper can also tend to have a high mechanical pulp content, but, even when all due care is exercised in selecting the wastepaper grade to minimize this, a high coarseness still often occurs. This is thought to be due to the impure mixture of fiber morphologies which naturally occurs when paper from many sources is blended to make a recycled pulp. For example, a certain wastepaper might be selected because it is primarily North American hardwood in nature; however, one will often find extensive contamination from coarser softwood fibers, even of the most deleterious species such as variations of Southern U.S. pine. U.S. Pat. No. 4,300,981, Carstens, issued Nov. 17, 1981, and incorporated herein by reference, explains the textural and surface qualities which are imparted by prime fibers. U.S. Pat. No. 5,228,954, Vinson, issued Jul. 20, 1993, and U.S. Pat. No. 5,405,499, Vinson issued Apr. 11, 1995, both incorporated herein by reference, disclose methods for upgrading such fiber sources so that they have less deleterious effects, but still the level of replacement is limited and the new fiber sources themselves are in limited supply and this often limits their use.

Applicants have discovered that another method of limiting the use of wood pulp in sanitary tissue paper is to replace part of it with a lower cost, readily available filling material such as kaolin clay or calcium carbonate. While those skilled in the art will recognize that this practice has been common in some parts of the paper industry for many years, they will also appreciate that extending this approach to sanitary tissue products has involved particular difficulties which have prevented it from being practiced up to now.

One major restriction is the retention of the filling agent during the papermaking process. Among paper products, sanitary tissues occupy an extreme of low basis weight. The basis weight of a tissue web as it is wound on a reel from a Yankee machine is typically only about 15 g/m$^2$ and because of the crepe, or foreshortening, introduced at the creping blade, the dry fiber basis weight in the forming, press, and drying sections of the machine is actually lower than the finished dry basis weight by from about 10% to about 20%. To compound the difficulties in retention caused by the low basis weight, tissue webs occupy an extreme of low density, often having an apparent density as wound on the reel of only about 0.1 g/cm$^3$ or less. While it is recognized that some of this loft is introduced at the creping blade, those skilled in the art will recognize that tissue webs are generally formed from relatively free stock which means that the fibers of which they are comprised are not rendered flaccid from beating. Tissue machines are required to operate at very high speeds to be practical; thus free stock is needed to prevent excessive forming pressures and drying load. The relatively stiff fibers comprising the free stock retain their ability to prop open the embryonic web as it is forming. Those skilled in the art will at once recognize that such light weight, low density structures do not afford any significant opportunity to filter fine particulates as the web is forming. Filler particles not substantively affixed to fiber surfaces will be tom away by the torrent of the high speed approach flow systems, hurled into the liquid phase, and driven through the embryonic web into the water drained from the forming web. Only with repeated recycling of the water used to form the web does the concentration of particulate build to a point where the filler begins to exit with the paper. Such concentrations of solids in water effluent are impractical.

A second major limitation is the general failure of particulate fillers to naturally bond to papermaking fibers in the fashion that papermaking fibers tend to bond to each other as the formed web is dried. This reduces the strength of the product. Filler inclusion causes a reduction in strength, which if left uncorrected, severely limits products which are already quite weak. Steps required to restore strength such as increased fiber beating or the use of chemical strengthening agents is often restricted as well.

The deleterious effects of filler on sheet integrity also often cause hygiene problems by plugging press felts or by transferring poorly from the press section to the Yankee dryer.

Finally, tissue products containing fillers are prone to lint or dust. This is not only because the fillers themselves can be poorly trapped within the web, but also because they have the aforementioned bend inhibiting effect which causes a localized weakening of fiber anchoring into the structure. This tendency can cause operational difficulties in the creped papermaking processes and in subsequent converting operations, because of excessive dust created when the paper is handled. Another consideration is that the users of the sanitary tissue products made from the filled tissue demand that they be relatively free of lint and dust.

Consequently, the use of fillers in papers made on Yankee machines has been severely limited. U.S. Pat. No. 2,216,143, issued to Thiele on Oct. 1, 1940, and incorporated herein by reference discusses the limitations of fillers on Yankee machines and discloses a method of incorporation which overcomes those limitations. Unfortunately, the method requires a cumbersome unit operation to coat a layer of adhesively bound particles onto the felt side of the sheet while it is in contact with the Yankee dryer. This operation is not practical for modem high speed Yankee machines and, those skilled in the art will recognize that the Thiele method would produce a coated rather than filled tissue product. A "filled tissue paper" is distinguished from "coated tissue paper" essentially by the methods practiced to produce them, i.e. a "filled tissue paper" is one which has the particulate matter added to the fibers prior to their assembly into a web while a "coated tissue paper" is one which has the particulate matter added after the web has been essentially assembled. As a result of this difference, a filled tissue paper product can be described as a relatively lightweight, low density creped tissue paper made on a Yankee machine which contains a filler dispersed throughout the thickness of at least one layer of a multi-layer tissue paper, or throughout the entire thickness of a single-layered tissue paper. The term "dispersed throughout" means that essentially all portions of a particular layer of a filled tissue product contain filler particles, but, it specifically does not imply that such dispersion necessarily be uniform in that layer. In fact, certain advantages can be anticipated by achieving a difference in filler concentration as a function of thickness in a filled layer of tissue.

Therefore, it is the object of the present invention to provide a process for incorporating a fine particulate filler into a creped tissue paper such as to overcome the aforementioned limitations of the prior art. The process disclosed herein enables the manufacture of creped tissue paper at high levels of retention of the filler; the resultant tissue is soft, has a high level of tensile strength, and is low in dust.

This and other objects are obtained using the present invention as will be taught in the following disclosure.

SUMMARY OF THE INVENTION

The invention is a process for incorporating a non-cellulosic fine particulate filler into a creped tissue paper. The process comprises the steps of:

a) contacting an aqueous dispersion of a non-cellulosic particulate filler with an aqueous dispersion of starch,
b) mixing the aqueous dispersion of starch-contacted filler with papermaking fibers forming an aqueous papermaking furnish comprising starch-contacted filler and papermaking fibers,
c) contacting said aqueous papermaking furnish with a flocculant,
d) forming an embryonic paper web from the aqueous papermaking furnish on foraminous papermaking clothing,
e) removing water from said embryonic web to form a semi-dry papermaking web,
f) adhering the semi-dry papermaking web to a Yankee dryer and drying said web to a substantially dry condition,
g) creping the substantially dry web from the Yankee dryer by means of a flexible creping blade, thereby forming a creped tissue paper.

In its preferred embodiment, the invention incorporates non-cellulosic particulate filler such that said filler comprises at least about 1% and up to about 50%, but, more preferably from about 8% to about 20% by weight of said tissue. Unexpected combinations of softness, strength, and resistance to dusting have been obtained by filling creped tissue paper with these levels of particulate fillers by the process of the present invention.

In its preferred embodiment, the filled tissue paper of the present invention has a basis weight between about 10 $g/m^2$ and about 50 $g/m^2$ and, more preferably, between about 10 $g/m^2$ and about 30 $g/m^2$. It has a density between about 0.03 $g/cm^3$ and about 0.6 $g/cm^3$ and, more preferably, between about 0.05 $g/cm^3$ and 0.2 $g/cm^3$.

The preferred embodiment further comprises papermaking fibers of both hardwood and softwood types wherein at least about 50% of the papermaking fibers are hardwood and at least about 10% are softwood. The hardwood and softwood fibers are most preferably isolated by relegating each to separate layers wherein the tissue comprises an inner layer and at least one outer layer.

The preferred practice of the process of the present invention utilizes a starch of minimum water solubility while it contacts the particulate filler of the present invention. Most preferably the starch possesses an electrostatic charge opposite that of the particulate filler such that it is attracted to the surface of the filler, so that the starch and filler tend to agglomerate when the two are brought into contact with one another in an aqueous dispersion.

The preferred flocculant used in the process of the present invention is a cationic polyelectrolyte; most preferred is a cationic polyacrylamide.

The preferred creped tissue papermaking process of the present invention uses pattern densification wherein water removal and transfer to the Yankee dryer is effected while the embryonic tissue web is supported by a drying fabric having an array of supports. This results in a creped tissue product having zones of relatively high density dispersed within a high bulk field. Such processes include pattern densification methods wherein zones of relatively high density are formed in continuous pattern while the high bulk field is formed in a discrete pattern. Most preferably, the tissue paper is through air dried.

In its preferred embodiment, the process of the present invention utilizes a particulate filler selected from the group consisting of clay, calcium carbonate, titanium dioxide, talc, aluminum silicate, calcium silicate, alumina trihydrate, activated carbon, pearl starch, calcium sulfate, glass microspheres, diatomaceous earth, and mixtures thereof. When selecting a filler from the above group several factors need to be evaluated. These include cost, availability, ease of retaining into the tissue paper, color, scattering potential, refractive index, and chemical compatibility with the selected papermaking environment.

It has now been found that a particularly suitable filler is kaolin day. Most preferably the so called "hydrous aluminum silicate" form of kaolin clay is preferred as contrasted to the kaolins which are further processed by calcining.

The morphology of kaolin is naturally platy or blocky, but it is preferable to use clays which have not been subjected to mechanical delamination treatments as this tends to reduce the mean particle size. It is common to refer to the mean particle size in terms of equivalent spherical diameter. An average equivalent spherical diameter greater than about 0.2 micron, more preferably greater than about 0.5 micron is preferred in the practice of the present invention. Most preferably, an equivalent spherical diameter greater than about 1.0 micron is preferred.

All percentages, ratios and proportions herein are by weight unless otherwise specified.

DETAILED DESCRIPTION OF THE INVENTION

Figure 1:
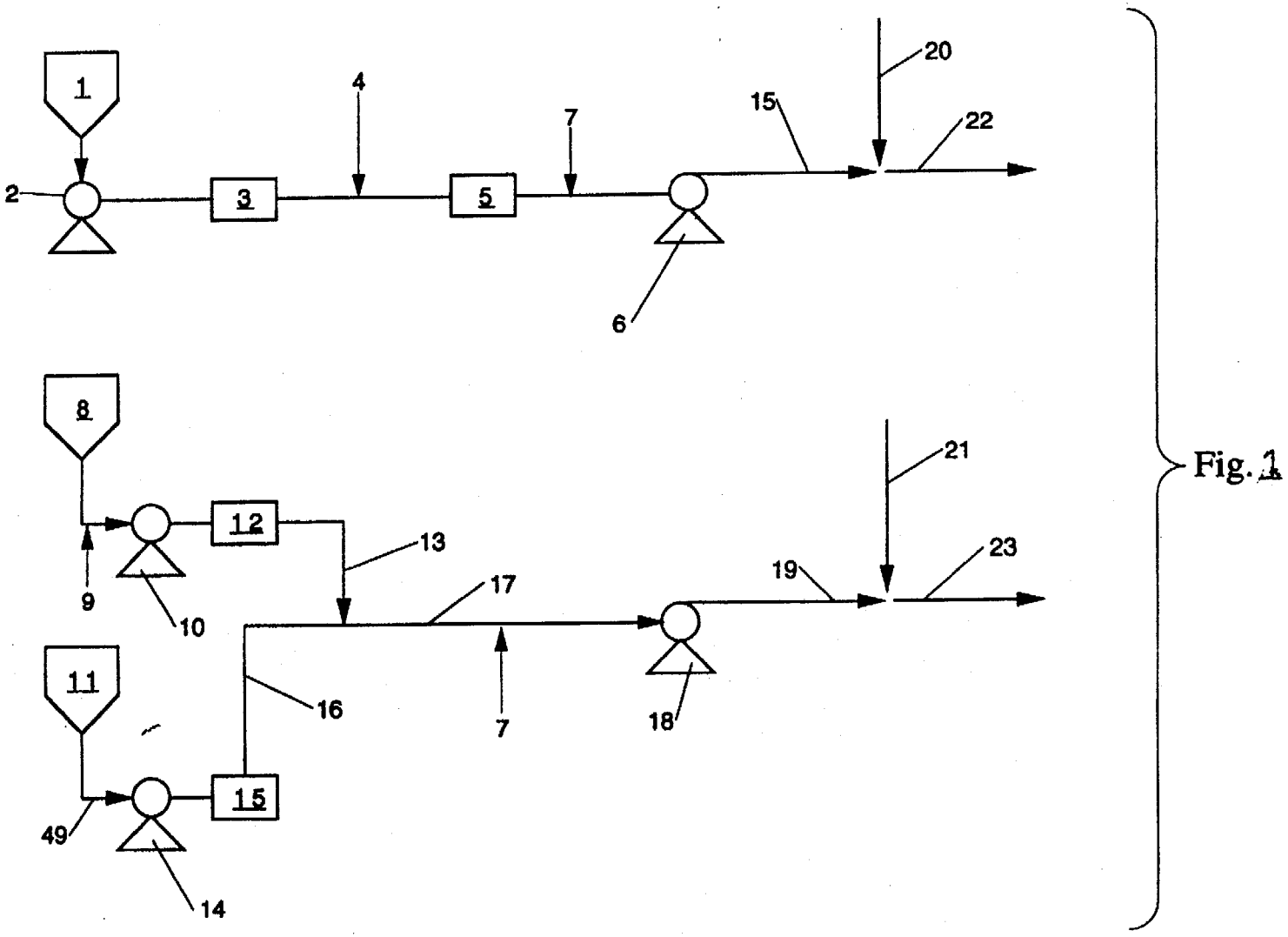
FIG. 1 is a schematic representation illustrating the steps for preparing the aqueous papermaking furnish for the creped papermaking process, according to the present invention.

While this specification concludes with claims particularly pointing out and distinctly claiming the subject matter regarded as the invention, it is believed that the invention can be better understood from a reading of the following detailed description and of the appended examples.

As used herein, the term "comprising" means that the various components, ingredients, or steps, can be conjointly employed in practicing the present invention. Accordingly, the term "comprising" encompasses the more restrictive terms "consisting essentially of" and "consisting of."

As used herein, the term "water soluble" refers to materials that are soluble in water to at least 3%, by weight, at 25° C.

As used herein, the terms "tissue paper web, paper web, web, paper sheet and paper product" all refer to sheets of paper made by a process comprising the steps of forming an aqueous papermaking furnish, depositing this furnish on a foraminous surface, such as a Fourdfinier wire, and removing the water from the furnish as by gravity or vacuum-assisted drainage, with or without pressing, and by evaporation, comprising the final steps of adhering the sheet in a semi-dry condition to the surface of a Yankee dryer, completing the water removal by evaporation to an essentially dry condition, removal of the web from the Yankee dryer by means of a flexible creping blade, and winding the resultant sheet onto a reel.

As used herein, the term "filled tissue paper" means a paper product that can be described as a relatively lightweight, low density creped tissue paper made on a Yankee machine which contains a filler dispersed throughout the thickness of at least one layer of a multi-layer tissue paper, or throughout the entire thickness of a single-layered tissue paper. The term "dispersed throughout" means that essentially all portions of a particular layer of a filled tissue product contain filler particles, but, it specifically does not imply that such dispersion necessarily be uniform in that Myer. In fact, certain advantages can be anticipated by achieving a difference in filler concentration as a function of thickness in a filled layer of tissue.

The terms "multi-layered tissue paper web, multi-layered paper web, multi-layered web, multi-layered paper sheet and multi-layered paper product" are all used interchangeably in the art to refer to sheets of paper prepared from two or more layers of aqueous paper making furnish which are preferably comprised of different fiber types, the fibers typically being relatively long softwood and relatively short hardwood fibers as used in tissue paper making. The layers are preferably formed from the deposition of separate streams of dilute fiber slurries upon one or more endless foraminous surfaces. If the individual layers are initially formed on separate foraminous surfaces, the layers can be subsequently combined when wet to form a multi-layered tissue paper web.

As used herein, the term "single-ply tissue product" means that it is comprised of one ply of creped tissue; the ply can be substantially homogeneous in nature or it can be a multi-layered tissue paper web. As used herein, the term "multi-ply tissue product" means that it is comprised of more than one ply of creped tissue. The plies of a multi-ply tissue product can be substantially homogeneous in nature or they can be multi-layered tissue paper webs.

The invention is a process for incorporating a fine particulate filler into a creped tissue paper said process comprising the steps of:

a) contacting an aqueous dispersion of a non-cellulosic particulate filler with an aqueous dispersion of starch,
b) mixing the aqueous dispersion of starch-contacted filler with papermaking fibers forming an aqueous papermaking furnish comprising starch-contacted filler and papermaking fibers,
c) contacting said aqueous papermaking furnish with a flocculant,
d) forming an embryonic paper web from the aqueous papermaking furnish on foraminous papermaking clothing,
e) removing water from said embryonic web to form a semi-dry papermaking web,
f) adhering the semi-dry papermaking web to a Yankee dryer and drying said web to a substantially dry condition,
g) creping the substantially dry web from the Yankee dryer by means of a flexible creping blade, thereby forming a creped tissue paper.

Alternatively, the invention is a process for incorporating a fine non-cellulosic particulate filler into a multi-layered creped tissue paper, said process comprising the steps of:

a) contacting an aqueous dispersion of a non-cellulosic particulate filler with an aqueous dispersion of starch,
b) mixing the aqueous dispersion of starch-contacted filler with papermaking fibers, thereby forming a filler-containing aqueous papermaking furnish comprising starch-contacted filler and papermaking fibers,
c) contacting said aqueous papermaking furnish with an aqueous dispersion of a flocculant,
d) providing at least one additional papermaking furnish,
e) directing said papermaking furnishes onto foraminous papermaking clothing; thereby forming an embryonic multi-layered paper web from the filler-containing aqueous papermaking furnish and the additional papermaking furnish in a manner to create a multi-layered paper web wherein at least one layer is formed from the filler-containing aqueous papermaking furnish and at least one layer is formed from said additional papermaking furnish,
f) removing water from said multi-layered embryonic web to form a semi-dry multi-layered papermaking web,
g) adhering the semi-dry multi-layered papermaking web to a Yankee dryer and drying said multi-layered web to a substantially dry condition,
h) creping the substantially dry multi-layered web from the Yankee dryer by means of a flexible creping blade, thereby forming a multi-layered creped tissue paper.

The following part of the specification details each of these steps of the process of the present invention.

Contacting Particulate Filler with Starch

The Particulate Filler

In its preferred embodiment, the invention incorporates non-cellulosic particulate filler such that said filler comprises at least about 1% and up to about 50%, but, more preferably from about 8% to about 20% by weight of said tissue. Unexpected combinations of softness, strength, and resistance to dusting have been obtained by filling creped tissue paper with these levels of particulate fillers by the process of the present invention.

The invention provides for a creped tissue paper comprising papermaking fibers and a particulate filler. In its preferred embodiment, the particulate filler is selected from the group consisting of clay, calcium carbonate, titanium dioxide, talc, aluminum silicate, calcium silicate, alumina trihydrate, activated carbon, pearl starch, calcium sulfate, glass microspheres, diatomaceous earth, and mixtures thereof. When selecting a filler from the above group several factors need to be evaluated. These include cost, availability, ease of retaining into the tissue paper, color, scattering potential, refractive index, and chemical compatibility with the selected papermaking environment.

It has now been found that a particularly suitable particulate filler is kaolin clay. Kaolin clay is the common name for a class of naturally occurring aluminum silicate mineral beneficiated as a particulate.

With respect to terminology, it is noted that it is common in the industry, as well as in the prior art patent literature, when referring to kaolin products or processing, to use the term "hydrous" to refer to kaolin which has not been subject to calcination. Calcination subjects the clay to temperatures above 450° C., which temperatures serve to alter the basic crystal structure of kaolin. The so-called "hydrous" kaolins may have been produced from crude kaolins, which have been subjected to beneficiation, as, for example, to froth flotation, to magnetic separation, to mechanical delamination, grinding, or similar comminution, but not to the mentioned heating as would impair the crystal structure.

To be accurate in a technical sense, the description of these materials as "hydrous" is inappropriate. More specifically, there is no molecular water actually present in the kaolinite structure. Thus although the composition can be, and often is, arbitrarily written in the form $2H_2O \cdot Al_2O_3 \cdot 2SiO_2$, it has long been known that kaolinite is an aluminum hydroxide silicate of approximate composition $Al_2(OH)_4Si_2O_5$, which equates to the hydrated formula just cited. Once kaolin is subjected to calcination, which for the purposes of this specification refers to subjecting a kaolin to temperatures exceeding 450° C., for a period sufficient to eliminate the hydroxyl groups, the original crystalline structure of the kaolinite is destroyed. Therefore, although technically such calcined clays are no longer "kaolin", it is common in the industry to refer to these as calcined kaolin, and, for the purposes of this specification, the calcined materials are included when the class of materials "kaolin" is cited. Accordingly, the term "hydrous aluminum silicate" refers to natural kaolin, which has not been subjected to calcination.

Hydrous aluminum silicate is the kaolin form most preferred in the practice of the present invention. It is therefore characterized by the before mentioned approximate 13% by weight loss as water vapor at temperatures exceeding 450° C.

The morphology of kaolin is naturally platy or blocky, because it naturally occurs in the form of thin platelets which adhere together to form "stacks" or "books". The stacks separate to some degree into the individual platelets during processing, but it is preferable to use clays which have not been subjected to extensive mechanical delamination treatments as this tends to reduce the mean particle size. It is common to refer to the mean particle size in terms of equivalent spherical diameter. An average equivalent spherical diameter greater than about 0.2μ, more preferably greater than about 0.5μ is preferred in the practice of the present invention. Most preferably, an equivalent spherical diameter greater than about 1μ, but less than about 5μ.

Most mined clay is subjected to wet processing. Aqueous suspending of the crude clay allows the coarse impurities to be removed by centrifugation and provides a media for chemical bleaching. A polyacrylate polymer or phosphate salt is sometimes added to such slurries to reduce viscosity and slow settling. Resultant clays are normally shipped without drying at about 70% solids suspensions, or they can be spray dried.

Treatments to the clay, such as air floating, froth flotation, washing, bleaching, spray drying, the addition of agents as slurry stabilizers and viscosity modifiers, are generally acceptable and should be selected based upon the specific commercial considerations at hand in a particular circumstance.

Each clay platelet is itself a multi-layered structure of aluminum polysilicates. A continuous array of oxygen atoms forms one face of each basic layer. The polysilicate sheet structure edges are united by these oxygen atoms. A continuous array of hydroxyl groups of joined octahedral alumina structures forms the other face forming a two-dimensional polyaluminum oxide structure. The oxygen atoms sharing the tetrahedral and octahedral structures bind the aluminum atoms to the silicon atoms.

Imperfections in the assembly are primarily responsible for the natural clay particles possessing an anionic charge in suspension. This happens because other di-, tri-, and tetravalent cations substitute for aluminum. The consequence is that some of the oxygen atoms on the surface become anionic and become weakly dissociable hydroxyl groups.

Natural clay also has a cationic character capable of exchanging their anions for others that are preferred. This happens because aluminum atoms lacking a full complement of bonds occur at some frequency around the peripheral edge of the platelet. They must satisfy their remaining valencies by attracting anions from the aqueous suspension that they occupy. If these cationic sites are not satisfied with anions from solutions, the clay can satisfy its own charge balance by orienting itself edge to face assembling a "card house" structure which forms thick dispersions. Polyacrylate dispersants ion exchange with the cationic sites providing a repulsive character to the clay preventing these assemblies and simplifying the production, shipping, and use of the clay.

A kaolin grade WW Fil® is a kaolin marketed by Dry Branch Kaolin Company of Dry Branch, Ga. suitable to make creped tissue paper webs of the present invention. It is available in either spray dried or in slurry (70% solids) form.

Starch

The present invention utilizes starch, added in amounts of about 0.1% to about 5%, but most preferably from about 0.25% to about 0.75%, by weight based on the weight of the particulate filler.

A starch that has limited solubility in water in the presence of particulate fillers and fibers is particularly useful in the present invention. A particularly preferred means of achieving this is to use a starch which possesses a charge opposite to that of the particulate filler so that, when the filler and the starch are suspended in aqueous medium, they tend to agglomerate. Since most particulate fillers possess a net anionic charge under practical papermaking conditions, the most preferred form of starch for the present invention is a so called "cationic starch".

As used herein the term "cationic starch" is defined as starch, as naturally derived, which has been further chemically modified to impart a cationic constituent moiety. Preferably the starch is derived from corn or potatoes, but can be derived from other sources such as rice, wheat, or tapioca. Starch from waxy maize also known industrially as amioca starch is particularly preferred. Amioca starch differs from common dent corn starch in that it is entirely amylopectin, whereas common corn starch contains both amylopectin and amylose. Various unique characteristics of amioca starch are further described in "Amioca—The Starch from Waxy Corn", H. H. Schopmeyer, Food Industries, December 1945, pp. 106–108.

Cationic starches can be divided into the following general classifications: (1) tertiary aminoalkyl ethers, (2) onium starch ethers including quaternary amines, phosphonium, and sulfonium derivatives, (3) primary and secondary aminoalkyl starches, and (4) miscellaneous (e.g., imino starches). New cationic products continue to be developed, but the tertiary aminoalkyl ethers and quaternary ammonium alkyl ethers are the main commercial types. Preferably, the cationic starch has a degree of substitution ranging from about 0.01 to about 0.1 cationic substituent per anhydroglucose units of starch; the substituents preferably chosen from the above mentioned types. Suitable starches are produced by National Starch and Chemical Company, (Bridgewater, N.J.) under the tradename, RediBOND®. Grades with cationic moieties only such as RediBOND 5320® and RediBOND 5327® are suitable, and grades with additional anionic functionality such as RediBOND 2005® are also suitable.

Contacting the Particulate Filler with the Starch

The selected particulate filler is first prepared by also dispersing it into an aqueous slurry. Dilution generally favors the absorption of polymers and retention aids onto solids surfaces; consequently, the slurry or slurries of particulate fillers at this point in the preparation is no more than about 10% and preferably from about 1–5% solids by weight.

Similarly, the starch is preferably properly dispersed in water prior to contacting the particulate filler. The raw starch can be in granular form, pre-gelatinized granular form, or dispersed form. While the dispersed form is preferred for ease of use, any form of raw starch can be used and none are disclaimed. If the raw starch is in granular pre-gelatinized form, it need only be dispersed in cold water prior to its use, with the only precaution being to use equipment which overcomes any tendency to gel-block in forming the dispersion. Suitable dispersers known as eductors are common in the industry. If the starch is in granular form and has not been pre-gelatinized, it is necessary to cook the starch to induce swelling of the granules. Preferably, such starch granules are swollen, as by cooking, to a point just prior to dispersion of the starch granule. Such highly swollen starch granules shall be referred to as being "fully cooked". The conditions for dispersion in general can vary depending upon the size of the starch granules, the degree of crystallinity of the granules, and the amount of amylose present. Fully cooked amioca starch, for example, can be prepared by heating an aqueous slurry of about 4% consistency of starch granules at about 190° F. (about 88° C.) for between about 30 and about 40 minutes.

After reaching a properly water dispersed starch, it need only be further diluted to the proper consistency for use. The preferred dilutions are below about 10% solids, but above about 0.1% solids. Most preferred dilutions are about 1% solids.

When both the particulate filler and the starch are brought to this condition, the two dispersions can be mixed. With cationic starch and anionic filler, the reaction between the starch and the particulate filler is relatively fast, and the minimum mount of time required to thoroughly mix the two is sufficient time for the reaction between the materials to occur as well.

While not wishing to be bound by theory, it is believed that the cationic starch which is initially dissolved in water, becomes insoluble in the presence of filler because of its attraction for the anionic sites on the filler surface. This causes the filler to be covered with the bushy starch molecules which provide an attractive surface for more filler particles, ultimately resulting in agglomeration of the filler. While the charge characteristics of the starch are important to aid in the formation of the agglomerates, the essential characteristic of the starch is believed to be related to the size and shape of the starch molecule rather than wholly its charge characteristics. For example, inferior results would be expected by substituting a charge biasing species such as synthetic linear polyelectrolyte for the cationic starch.

Mixing the Starch and Filler with Papermaking Fibers

The Papermaking Fibers

It is anticipated that wood pulp in all its varieties will normally comprise the papermaking fibers used in this invention. However, other cellulose fibrous pulps, such as cotton linters, bagasse, rayon, etc., can be used and none are disclaimed. Wood pulps useful herein include chemical pulps such as, sulfite and sulfate (sometimes called Kraft) pulps as well as mechanical pulps including for example, ground wood, ThermoMechanical Pulp (TMP) and Chemi-ThermoMechanical Pulp (CTMP). Pulps derived from both deciduous and coniferous trees can be used.

Both hardwood pulps and softwood pulps as well as combinations of the two may be employed as papermaking fibers for the tissue paper of the present invention. The term "hardwood pulps" as used herein refers to fibrous pulp derived from the woody substance of deciduous trees (angiosperms), whereas "softwood pulps" are fibrous pulps derived from the woody substance of coniferous trees (gymnosperms). Blends of hardwood Kraft pulps, especially eucalyptus, and northern softwood Kraft (NSK) pulps are particularly suitable for making the tissue webs of the present invention. A preferred embodiment of the present invention comprises forming layered tissue webs wherein, most preferably, hardwood pulps such as eucalyptus are used for outer layer(s) and wherein northern softwood Kraft pulps are used for the inner layer(s). Also applicable to the present invention are fibers derived from recycled paper, which may contain any or all of the above categories of fibers.

Papermaking fibers are first prepared by liberating the individual fibers into a aqueous slurry by any of the common pulping methods adequately described in the prior art. Refining, if necessary, is then carried out on the selected parts of the papermaking furnish. It has been found that there are advantages in retention and in reducing lint, if the aqueous slurry of papermaking fibers which will later be used to adsorb the particulate filler is refined at least to the equivalent of a Canadian Standard Freeness of about 600 ml, but, more preferably about 550 ml or below.

In one preferred embodiment of the present invention, which utilizes multiple papermaking furnishes, the furnish containing the papermaking fibers which will be contacted by the particulate filler is predominantly of the hardwood type, preferably of content of at least about 80% hardwood.

Dilution generally favors the absorption of polymers and retention aids; consequently, the slurry or slurries of papermaking fibers at this point in the preparation is preferably no more than from about 3–5% solids by weight.

Mixing the Starch and Filler with Papermaking Fibers

In preparation to be used in the present invention, it is only necessary to prepare the papermaking fibers by forming an aqueous slurry with them in a conventional repulper. In this form, it is most convenient to slurry the fibers at less than about 15%, and more preferably from about 3% to about 5% in water.

After forming an aqueous slurry of the papermaking fibers, they can be mixed by any conventional batch or continuous processes with the combined starch and particulate filler composition previously formed.

The resultant aqueous papermaking furnish is now prepared for contacting with the cationic flocculant.

Contacting the Aqueous Papermaking Furnish with the Flocculant

Flocculant

Flocculants are part of a class of materials marketed by the trade as so-called "retention aids" a term, as used herein, referring to additives used to increase the retention of the fine furnish solids in the web during the papermaking process. Without adequate retention of the fine solids, they are either lost to the process effluent or accumulate to excessively high concentrations in the recirculating white water loop and cause production difficulties including deposit build-up and impaired drainage. Chapter 17 entitled "Retention Chemistry" of "Pulp and Paper, Chemistry and Chemical Technology", 3rd ed. Vol. 3, by J. E. Unbehend and K. W. Britt, A Wiley Interscience Publication, incorporated herein by reference, provides the essential understanding of the types and mechanisms by which polymeric retention aids function. A flocculant agglomerates suspended particles generally by a bridging mechanism. While certain multivalent cations are considered common flocculants, they are generally being replaced in practice by superior acting polymers which carry many charge along the polymer chain.

The process of the present invention uses as a retention aid a "flocculant", a term which, as used herein, refers to a chemical species having a plurality of charges of either the anionic or cationic type or a combination of the two, so that it is capable of bridging together charged particles in aqueous suspensions. It is well known in the papermaking field that shear stages break down the flocs formed by flocculating agents, and hence it is preferred practice to add the flocculating agent after as many shear stages encountered by the aqueous papermaking slurry as feasible.

One type of flocculant acceptable for use in the present invention is an "anionic polyelectrolyte polymer", a term which, as used herein, refers to a high molecular weight polymer having pendant anionic groups.

Anionic polymers often have a carboxylic acid (—COOH) moiety. These can be immediately pendant to the polymer backbone or pendant through typically, an alkalene group, particularly an alkalene group of a few carbons. In aqueous medium, except at low pH, such carboxylic acid groups ionize to provide to the polymer a negative charge.

Anionic polymers suitable for anionic flocculants do not wholly or essentially consist of monomeric units prone to yield a carboxylic acid group upon polymerization, instead they are comprised of a combination of monomers yielding both nonionic and anionic functionality. Monomers yielding nonionic functionality, especially if possessing a polar character, often exhibit the same flocculating tendencies as ionic functionality. The incorporation of such monomers is often practiced for this reason. An often used nonionic unit is (meth)acrylamide.

Anionic polyacrylamides having relatively high molecular weights are satisfactory flocculating agents. Such anionic polyacrylamides contain a combination of (meth)acrylamide and (meth)acrylic acid, the latter of which can be derived from the incorporation of (meth)acrylic acid monomer during the polymerization step or by the hydrolysis of some (meth)acrylamide units after the polymerization, or combined methods.

The polymer is preferably substantially linear in comparison to the globular structure of anionic starch.

A wide range of charge densities is satisfactory for the present invention, although a medium density is preferred. Polymers useful to make products of the present invention contain cationic functional groups at a frequency ranging from as low as about 0.2 to as high as about 7 or higher, but more preferably in a range of about 2 to about 4 milliequivalents per gram of polymer.

Polymers useful for the process according to the present invention should have a molecular weight of at least about 500,000, and preferably a molecular weight above about 1,000,000, and may advantageously have a molecular weight above 5,000,000.

An example of an acceptable material is RETEN 235®, which is delivered as a solid granule; a product of Hercules, Inc. of Wilmington, Del. Other acceptable anionic polyelectrolyte are Accurac 62® and Accurac 171RS®, products of Cytec, Inc. of Stamford, Conn. All of these products are polyacrylamides, specifically, copolymers of acrylamide and acrylic acid.

An even more preferred type of flocculant for use in the present invention is an "cationic polyelectrolyte polymer", a term which, as used herein, refers to a high molecular weight polymer having pendant cationic groups.

A "cationic flocculant", a term as used herein, refers to a class of polyelectrolyte which generally originate from copolymerization of one or more ethylenically unsaturated monomers, generally acrylic monomers, that consist of or include cationic monomer.

Suitable cationic monomers are dialkyl amino alkyl-(meth)acrylates or -(meth)acrylamides, either as acid salts or quaternary ammonium salts. Suitable alkyl groups include dialkylaminoethyl (meth)acrylates, dialkylaminoethyl (meth)acrylamides and dialkylaminomethyl(meth) acrylamides and dialkylamino-1,3-propyl (meth) acrylamides. These cationic monomers are preferably copolymerized with a nonionic monomer, preferably acrylamide. Other suitable polymers are polyethylene imines, polyamide epichlorohydrin polymers, and homopolymers or copolymers, generally with acrylamide, of monomers such as diallyl dimethyl ammonium chloride.

The flocculant is preferably a substantially linear polymer in comparison, for example, to the globular structure of cationized starches.

A wide range of charge densities is useful, although a medium density is preferred. Polymers useful to make products of the present invention contain cationic functional groups at a frequency ranging from as low as about 0.2 to as high as 2.5, but more preferably in a range of about 1 to about 1.5 milliequivalents per gram of polymer.

Polymers useful to make tissue products according to the present invention should have a molecular weight of at least about 500,000, and preferably a molecular weight above about 1,000,000, and, may advantageously have a molecular weight above 5,000,000.

Examples of acceptable materials are RETEN 1232® and Microform 2321®, both emulsion polymerized cationic polyacrylamides and RETEN 157®, which is delivered as a solid granule; all are products of Hercules, Inc. of Wilmington, Del. Another acceptable cationic flocculant is Accurac 91, a product of Cytec, Inc. of Stamford, Conn.

Contacting the Aqueous Furnish and the Flocculant

The flocculant is added to the aqueous papermaking furnish which is comprised of a mixture of papermaking fibers and a starch-treated particulate filler composition. It can be added at any suitable point in the approach flow of the stock preparation system of the papermaking process. It is particularly preferred to add the cationic flocculant after the fan pump in which the final dilution with the recycled machine water returned from the process is made. It is well known in the papermaking field that shear stages break down bridges formed by flocculating agents, and hence it is preferred practice to add the flocculating agent after as many shear stages encountered by the aqueous papermaking slurry as feasible.

The dilution which takes place at the fan pump preferably reduces the consistency to a point below about 0.5% solids, and most preferably between about 0.05%–0.2%.

The flocculant is delivered as an aqueous dispersion. Because of the relatively high molecular weight of the flocculant, the solids content of the aqueous dispersion needs to be low. Preferably, the solids content of the aqueous dispersion of the cationic flocculant is less than about 0.3% solids.

Whether the polymer chosen for this application is of the anionic or cationic type, they will be delivered as aqueous solutions at comparable concentrations and overall usage rates. It is preferred that the concentration of these polymers be below about 0.3% solids and more preferably below about 0.1% prior to contacting them with aqueous papermaking furnishes. Those skilled in the art will recognize that the desired usage rates of these polymers will vary widely. Amounts as low as about 0.005% polymer by weight based on the dry weight of the polymer and the dry finished weight of tissue paper will deliver useful results, but normally the usage rate would be expected to be higher; even higher for the purposes of the present invention than commonly practiced as application of these materials. Amounts as high as about 0.5% might be employed, but normally about 0.1% is optimum.

In the present invention, it is possible to utilize multiple aqueous papermaking slurries, one or more of the slurries can be used to adsorb particulate fibers in accordance with the present invention. Even if one or more aqueous slurries of papermaking fibers in the papermaking process is maintained relatively free of particulate fillers prior to reaching its fan pump, it is preferred to add a flocculant after the fan pump of such slurries. This is because the recycled water used in that fan pump contains filler agglomerates which failed to retain in previous passes over the foraminous screen. When multiple dilute fiber slurries are used in the creped papermaking process, the flow of cationic or anionic flocculant is preferably added to all dilute fiber slurries and it should be added in a manner which approximately proportions it to the flow of solids in the aqueous papermaking furnish of each dilute fiber slurry.

Additional Furnishes

In one aspect of the present invention, multiple papermaking furnishes are provided. In this case, it is desirable for the papermaking fibers used to contact the fine particulate filler be of the hardwood type, preferably at least about 80% hardwood. In this aspect, at least one additional furnish would be provided, preferably predominantly of longer, and coarser fibered softwood type, preferably of greater than 80% softwood content. This latter furnish, preferably of softwood type, is preferably maintained relatively free of the fine particulate filler.

In a most preferred aspect of the present invention, these furnishes would be discharged onto foraminous papermaking clothing in such a manner so that they are maintained in separate layers thorough the paper forming process. One specifically desirable practice, is to relegate the particulate-filler contacted papermaking fibers into a multi-layered tissue paper web wherein three layers are provided. The three layers comprise two outer layers formed from the particulate filler contacted papermaking fibers surrounding an inner layer formed from a furnish relatively free of fine particulate fillers.

Forming an Embryonic Paper Web

In its simplest form, the present invention prescribes forming an embryonic paper web by directing a dilute slurry from a fan pump and discharging it onto a foraminous surface such as a papermaking wire as is well known in the art. The equipment and methods to accomplish this are well known to those skilled in the art. In a typical process, a low consistency pulp furnish is provided in a pressurized headbox. The headbox has an opening for delivering a thin deposit of pulp furnish onto the Fourdrinier wire to form a embryonic web.

To aid in this process, a headbox is used to maintain a uniform flow of the dilute slurry onto the papermaking surface. More elaborate arrangements can also be used, as, for example, when multiple papermaking slurries are used to make a layered paper web. In such a case, the headbox is preferably chambered so as to maintain the multiple slurries separate as long as possible. This allows the maximum amount of layer purity.

In one preferred arrangement, a flurry of relatively short papermaking fibers, comprising hardwood pulp, is prepared and used to adsorb fine particulate fibers, while a slurry of relatively long papermaking fibers, comprising softwood pulp, is prepared and left essentially free of fine particulates. The fate of the resultant short fibered slurry is to be directed to the outer chambers of a three chambered headbox to form outer layers of a three layered tissue in which a long fibered inner layer is formed out of a inner chamber in the headbox in which the slurry of relatively long papermaking fibers is directed. The resultant three-layered web with predominantly short, hardwood fibers and filler in its outer layers, and longer-fibered, predominantly softwood fibers in its inner layers yields a filled tissue web which is particularly suitable for converting into a single-ply tissue product.

In an alternate preferred arrangement, a slurry of relatively short papermaking fibers, comprising hardwood pulp, is prepared and used to adsorb fine particulate fibers, while a slurry of relatively long papermaking fibers, comprising softwood pulp, is prepared and left essentially free of fine particulates. The fate of the resultant short fibered slurry is to be directed to one chamber of a two chambered headbox to form one layer of a two layered tissue in which a long fibered alternate layer is formed out of the second chamber in the headbox in which the slurry of relatively long papermaking fibers is directed. The resultant filled tissue web is particularly suitable for converting into a multi-ply tissue product comprising two plies in which each ply is oriented so that the layer comprised of relatively short papermaking fibers is on the surface of the two-ply tissue product.

Those skilled in the art will also recognize that the apparent number of chambers of a headbox can be reduced by directing the same type of aqueous papermaking furnish to adjacent chambers. For example, the aforementioned three chambered headbox could be used as a two chambered headbox simply by directing essentially the same aqueous papermaking furnish to either of two adjacent chambers.

Water Removal to Form a Semi-Dry Web

Upon depositing the dilute fiber slurry onto the foraminous surface, it begins to dewater by gravity, aided by vacuum as needed, by mechanical means conventional in the art to increase the solids content to about 7–25% thereby completing the conversion of the slurry into a wet paper web.

The scope of the present invention also includes processes which form multiple paper layers in which two or more layers of furnish are preferably formed from the deposition of separate streams of dilute fiber slurries for example in a multi-channeled headbox. The layers are preferably comprised of different fiber types, the fibers typically being relatively long softwood and relatively short hardwood fibers as used in multi-layered tissue paper making. If the individual layers are initially formed on separate wires, the layers are subsequently combined when wet to form a multi-layered tissue paper web. The papermaking fibers are preferably comprised of different fiber types, the fibers typically being relatively long softwood and relatively short hardwood fibers. More preferably, the hardwood fibers comprise at least about 50% and said softwood fibers comprise at least about 10% of said papermaking fibers.

In the papermaking process of the present invention, the water removal step preferably comprises the transfer of the web to a felt or fabric, e.g., conventionally felt pressing tissue paper, well known in the art, is expressly included within the scope of this invention. In this process step, the web is dewatered by transferring to a dewatering felt and pressing the web so that water is removed from the web into the felt by pressing operations wherein the web is subjected to pressure developed by opposing mechanical members, for example, cylindrical rolls. Because of the substantial pressures needed to de-water the web in this fashion, the resultant webs made by conventional felt pressing are relatively high in density and are characterized by having a uniform density throughout the web structure.

More preferable variations of the papermaking process incorporated into the present invention include the so-called pattern densification process methods wherein water removal and transfer to the Yankee dryer is effected while the embryonic tissue web is supported by a drying fabric having an array of supports. This results in a creped tissue product having zones of relatively high density dispersed within a high bulk field. The high bulk field is alternatively characterized as a field of pillow regions. The densified zones are alternatively referred to as knuckle regions. The densified zones may be discretely spaced within the high bulk field or may be interconnected, either fully or partially, within the high bulk field. Preferably, the zones of relatively high density are continuous and the high bulk field is discrete. Preferred processes for making pattern densified tissue webs are disclosed in U.S. Pat. No. 3,301,746, issued to Sanford and Sisson on Jan. 31, 1967, U.S. Pat. No. 3,974,025, issued to Peter G. Ayers on Aug. 10, 1976, and U.S. Pat. No. 4,191,609, issued to Paul D. Trokhan on Mar. 4, 1980, and U.S. Pat. No. 4,637,859, issued to Paul D. Trokhan on Jan. 20, 1987, U.S. Pat. No. 4,942,077 issued to Wendt et al. on Jul. 17, 1990, European Patent Publication No. 0 617 164 A1, Hyland et al., published Sep. 28, 1994, European Patent Publication No. 0 616 074 Ab1, Hermans et al., published Sep. 21, 1994; all of which are incorporated herein by reference.

To form pattern densified webs, the web transfer step immediately after forming the web is to a forming fabric rather than a felt: The web is juxtaposed against an array of supports comprising the forming fabric. The web is pressed against the array of supports, thereby resulting in densified zones in the web at the locations geographically corresponding to the points of contact between the array of supports and the wet web. The remainder of the web not compressed during this operation is referred to as the high bulk field. This high bulk field can be further dedensified by application of fluid pressure, such as with a vacuum type device or a blow-through dryer. The web is dewatered, and optionally predried, in such a manner so as to substantially avoid compression of the high bulk field. This is preferably accomplished by fluid pressure, such as with a vacuum type device or blow-through dryer, or alternately by mechanically pressing the web against an array of supports wherein the high bulk field is not compressed. The operations of dewatering, optional predrying and formation of the densified zones may be integrated or partially integrated to reduce the total number of processing steps performed. The moisture content of the semi-dry web at the point of transfer to the Yankee surface is less than about 40% and the hot air is forced through said semi-dry web while the semi-dry web is on said forming fabric to form a low density structure.

The array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, Sanford and Sisson, issued Jan. 31, 1967, U.S. Pat. No. 3,821,068, Salvucci, Jr. et al., issued May 21, 1974, U.S. Pat. No. 3,974,025, Ayers, issued Aug. 10, 1976, U.S. Pat. No. 3,573,164, Fredberg et al., issued Mar. 30, 1971, U.S. Pat. No. 3,473,576, Amneus, issued Oct. 21, 1969, U.S. Pat. No. 4,239,065, Trokhan, issued Dec. 16, 1980, and U.S. Pat. No. 4,528,239, Trokhan, issued Jul. 9, 1985, all of which are incorporated herein by reference.

Most preferably, the embryonic web is caused to conform to the surface of an open mesh drying/imprinting fabric by the application of a fluid force to the web and thereafter thermally predried on said fabric as part of a low density paper making process.

Another variation of the processing steps included within the present invention includes the formation of, so-called uncompacted, non pattern-densified multi-layered tissue paper structures such as are described in U.S. Pat. No. 3,812,000 issued to Joseph L. Salvucci, Jr. and Peter N. Yiannos on May 21, 1974 and U.S. Pat. No. 4,208,459, issued to Henry E. Becker, Albert L. McConnell, and Richard Schutte on Jun. 17, 1980, both of which are incorporated herein by reference. In general uncompacted, non pattern densified multi-layered tissue paper structures are prepared by depositing a paper making furnish on a foraminous forming wire such as a Fourdrinier wire to form a wet web as described earlier herein. The processes differ from the aforementioned felt pressed and pattern densified processes however in that the draining of the web and removing additional water is effected without mechanical compression. Water removal is accomplished from the web by vacuum dewatering and thermal drying. The web has a fiber consistency of at least 80%, prior to creping the web, said subsequent Yankee drying and creping steps therein carried out in a manner as is described hereinafter as applying to similarly to conventionally felt pressed and pattern densifing processes. The resulting high bulk sheet of relatively uncompacted fibers structure is soft but weak; therefore bonding material is preferably applied to portions of the web prior to creping.

Yankee Drying

Regardless of the method chosen to effect the dewatering of the wet paper web, the creped papermaking process as described herein utilizes a cylindrical steam drum apparatus known in the art as a Yankee dryer to effect completion of the drying. This step is effected by pressing the semi-dry papermaking web in order to adhere it to the Yankee dryer and drying said web to a substantially dry condition. The transfer is effected by mechanical means such as an opposing cylindrical drum pressing against the web. Vacuum may also be applied to the web as it is pressed against the Yankee surface. Multiple Yankee dryer drums can be employed in the process of the present invention.

The consistency of the semi-dry web at the point at which it is transferred to the Yankee dryer can vary considerably. In general, felt pressed paper structures can be delivered to the Yankee dryer at a higher moisture content owing to the fact that the web has a uniform contact with the dryer surface. The consistency of the web at transfer in such as case typically is about 20%–40%.

For Yankee drying a pattern densified web, the consistency at the point of transfer is at least about 40% and is typically from about 50% to about 80%. is transferred to the Yankee dryer and dried to completion, preferably still avoiding mechanical pressing. In the present invention, preferably from about 8% to about 55% of the creped tissue paper surface comprises densified knuckles having a relative density of at least 125% of the density of the high bulk field.

Creping

In the final step of the present invention, the substantially dry web is creped from the Yankee dryer surface by means of a flexible creping blade, forming a creped tissue paper, such means being well known to those skilled in the art.

In order to aid in adhering the web to the Yankee dryer, any of a number of adhesives and coatings can optionally be used preferably by praying them onto the surface of the web or onto the Yankee dryer. Many such products designed for controlling adhesion to the Yankee dryer are known in the art. For example, U.S. Pat. No. 3,926,716, Bates, incorporated here by reference, discloses a process using an aqueous dispersion of polyvinyl alcohol of certain degree of hydrolysis and viscosity for improving the adhesion of paper webs to Yankee dryers. Such polyvinyl alcohols, sold under the tradename Airvol® by Air Products and Chemicals, Inc. of Allentown, Pa. can be used in conjunction with the present invention. Other Yankee coatings similarly recommended for use directly on the Yankee or on the surface of the sheet are cationic polyamide or polyamine resins such as those made under the tradename Rezosol® and Unisoft® by Houghton International of Valley Forge, Pa. and the Crepetrol® tradename by Hercules, Inc. of Wilmington, Del. These can also be used with the present invention. Preferably the web is secured to the Yankee dryer by means of an adhesive selected from the group consisting of partially hydrolyzed polyvinyl alcohol resin, polyamide resin, polyamine resin, mineral oil, and mixtures thereof.

Optional Chemical Additives

Other materials can be added to the aqueous papermaking furnish or the embryonic web to impart other characteristics to the product or improve the papermaking process so long as they are compatible with the chemistry of the selected particulate filler and do not significantly and adversely affect the softness, strength, or low dusting character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. Many experts in the field believe that a cationic charge biasing species is desirable as it partially neutralizes these solids, making them more easily flocculated by cationic flocculants such as the before mentioned cationic starch and cationic polyelectrolyte. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. One suitable material is Cypro 514®, a product of Cytec, Inc. of Stamford, Conn. The use of such materials is expressly allowed within the practice of the present invention. Caution should be used in their application, however. It is well known that while a small amount of such agents can actually aid retention by neutralizing anionic centers inaccessible to the larger flocculant molecules and thereby lowering the particle repulsion; however, since such materials can compete with cationic flocculants for anionic anchoring sites, they can actually have an effect opposite to the intended one by negatively impacting retention when anionic sites are limited.

The use of high surface area, high anionic charge microparticles for the purposes of improving formation, drainage, strength, and retention is well taught in the art. See, for example, U.S. Pat. No. 5,221,435, issued to Smith on Jun. 22, 1993, incorporated herein by reference. Common materials for this purpose are silica colloid, or bentonite clay. The incorporation of such materials is expressly included within the scope of the present invention.

If permanent wet strength is desired, the group of chemicals: including polyamide-epichlorohydrin, polyacrylamides, styrene-butadiene latices; insolubilized polyvinyl alcohol; urea-formaldehyde; polyethyleneimine; chitosan polymers and mixtures thereof can be added to the papermaking furnish or to the embryonic web. Polyamide-epichlorohydrin resins are cationic wet strength resins which have been found to be of particular utility. Suitable types of such resins are described in U.S. Pat. No. 3,700,623, issued on Oct. 24, 1972, and U.S. Pat. No. 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the mark Kymene 557H®.

Many creped paper products must have limited strength when wet because of the need to dispose of them through toilets into septic or sewer systems. If wet strength is imparted to these products, it is preferred to be fugitive wet strength characterized by a decay of part or all of its potency upon standing in presence of water. If fugitive wet strength is desired, the binder materials can be chosen from the group consisting of dialdehyde starch or other resins with aldehyde functionality such as Co-Bond 1000® offered by National Starch and Chemical Company, Parez 750® offered by Cytec of Stamford, Conn. and the resin described in U.S. Pat. No. 4,981,557 issued on Jan. 1, 1991, to Bjorkquist and incorporated herein by reference.

If enhanced absorbency is needed, surfactants may be used to treat the creped tissue paper webs of the present invention. The level of suffactant, if used, is preferably from about 0.01% to about 2.0% by weight, based on the dry fiber weight of the tissue paper. The surfactants preferably have alkyl chains with eight or more carbon atoms. Exemplary anionic surfactants are linear alkyl sulfonates, and alkylbenzene sulfonates. Exemplary nonionic surfactants are alkylglycosides including alkylglycoside esters such as Crodesta SL-40® which is available from Croda, Inc. (New York, N.Y.); alkylglyeoside ethers as described in U.S. Pat. No. 4,011,389, issued to W. K. Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.).

Chemical softening agents are expressly included as optional ingredients. Acceptable chemical softening agents comprise the well known dialkyldimethylammonium salts such as ditallowdimethylammonium chloride, ditallowdimethylammonium methyl sulfate, di(hydrogenated) tallow dimethyl ammonium chloride; with di(hydrogenated) tallow dimethyl ammonium methyl sulfate being preferred. This particular material is available commercially from Witco Chemical Company Inc. of Dublin, Ohio under the tradename Varisoft 137®. Biodegradable mono and di-ester variations of the quaternary ammonium compound can also be used and are within the scope of the present invention.

The above listings of optional chemical additives is intended to be merely exemplary in nature, and are not meant to limit the scope of the invention.

Figure 2:
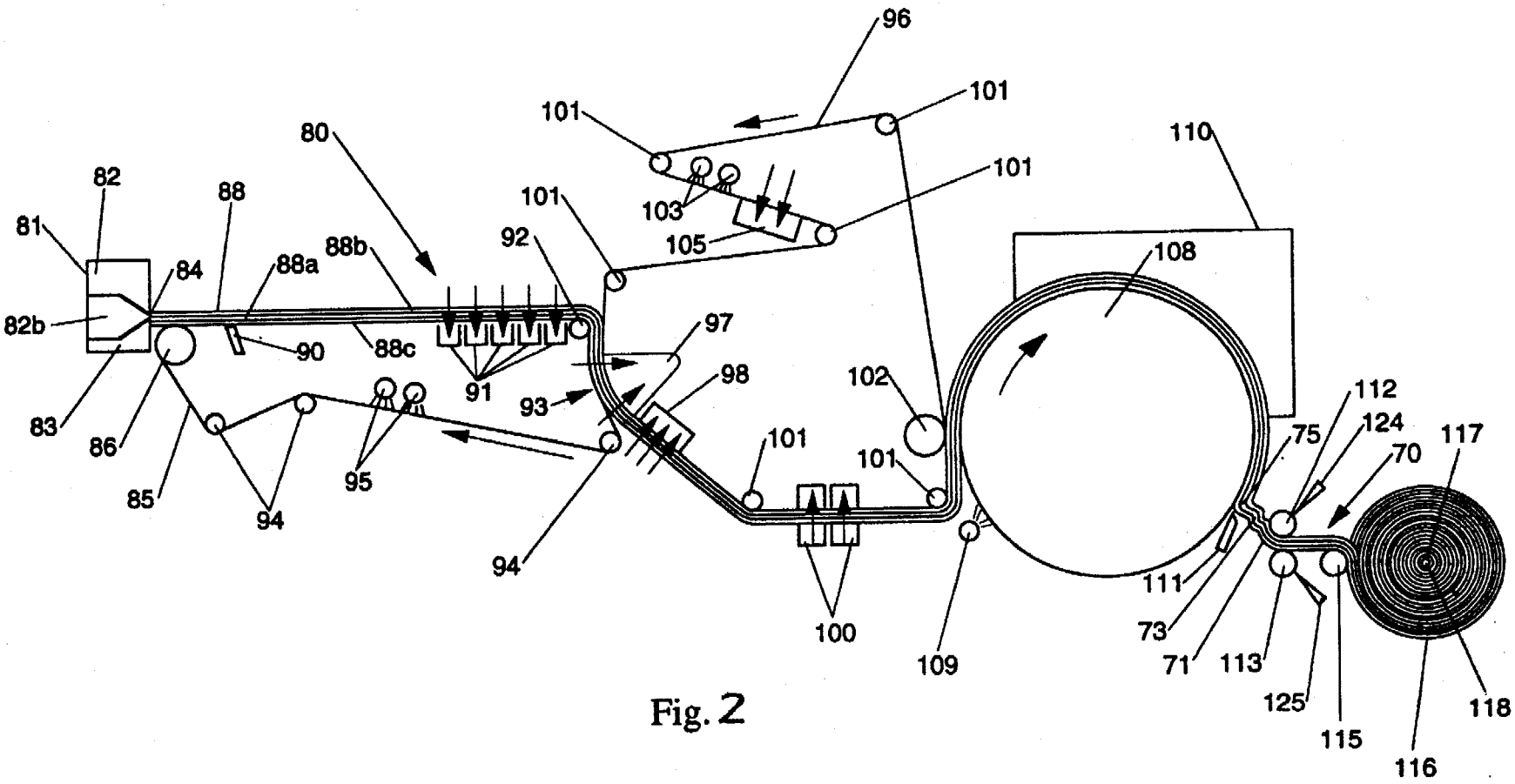
FIG. 2 is a schematic representation illustrating a creped papermaking process according to the present invention for producing a strong, soft, and low lint creped tissue paper comprising papermaking fibers and particulate fillers.

Detailed Description of the Drawings Further insight into the process of the present invention can be gained by reference to FIG. 1, which is a schematic representation illustrating a preparation of the aqueous papermaking furnish for the creped papermaking preparation, and to FIG. 2, which is a schematic representation of the creped papermaking operation.

The following description makes reference to FIG. 1:

A storage vessel 1 is provided for staging an aqueous slurry of relatively long papermaking fibers. The slurry is conveyed by means of a pump 2 and optionally through a refiner 3 to fully develop the strength potential of the long papermaking fibers. Additive pipe 4 conveys a resin to provide for wet or dry strength, as desired in the finished product. The slurry is then further conditioned in mixer 5 to aid in absorption of the resin. The suitably conditioned slurry is then diluted with white water 7 in a fan pump 6 forming a dilute long papermaking fiber slurry 15. Pipe 20 adds a flocculant to the slurry 15, producing a flocculated long fibered slurry 22.

Still referring to FIG. 1, a storage vessel 8 is a repository for a fine particulate filler slurry. Additive pipe 9 conveys an aqueous dispersion of a cationic starch additive. Pump 10 acts to convey the fine particulate slurry as well as provide for dispersion of the starch. The slurry is conditioned in a mixer 12 to aid in absorption of the additives. Resultant slurry 13 is conveyed to a point where it is mixed with an aqueous dispersion of refined short fiber papermaking fibers.

Still referring to FIG. 1, short papermaking fiber slurry originates from a repository 11, from which it is conveyed through pipe 49 by pump 14 through a refiner 15 where it becomes a refined slurry of short papermaking fibers 16. After mixing with the conditioned slurry of fine particulate filler 13, it becomes the short fiber based aqueous papermaking slurry 17. White water 7 is mixed with slurry 17 in a fan pump 18 at which point the slurry becomes a dilute aqueous papermaking slurry 19. Pipe 21 directs a flocculant into slurry 19, after which the slurry becomes a flocculated aqueous papermaking slurry 23.

Preferably, the flocculated short-fiber based aqueous papermaking slurry 23 is directed to the creped papermaking process illustrated in FIG. 2 and is divided into two approximately equal streams which are then directed into headbox chambers 82 and 83 ultimately evolving into off-Yankee-side-layer 75 and Yankee-side-layer 71, respectively of the strong, soft, low dusting, filled creped tissue paper. Similarly, the aqueous flocculated long papermaking fiber slurry 22, referring to FIG. 1, is preferably directed into headbox chamber **82*b* ultimately evolving into center layer 73** of the strong, soft, low dusting, filled creped tissue paper.

The following description makes reference to FIG. 2:

FIG. 2 is a schematic representation illustrating a creped papermaking process for producing a strong, soft, and low dust filled creped tissue paper. Preferred embodiments are described in the following discussion. FIG. 2 is a side elevational view of a preferred papermaking machine 80 for manufacturing paper according to the present invention. Referring to FIG. 2, papermaking machine 80 comprises a layered headbox 81 having a top chamber 82 a center chamber **82*b*, and a bottom chamber 83, a slice roof 84, and a Fourdrinier wire 85 which is looped over and about breast roll 86, deflector 90, vacuum suction boxes 91, couch roll 92, and a plurality of turning rolls 94. In operation, one papermaking furnish is pumped through top chamber 82 a second papermaking furnish is pumped through center chamber 82*b*, while a third furnish is pumped through bottom chamber 83 and thence out of the slice roof 84 in over and under relation onto Fourdrinier wire 85 to form thereon an embryonic web 88 comprising layers 88*a***, and 88*b*, and 81*c*. Dewatering occurs through the Fourdrinier wire 85 and is assisted by deflector 90 and vacuum boxes 91. As the Fourdrinier wire makes its return run in the direction shown by the arrow, showers 95 clean it prior to its commencing another pass over breast roll 86. At web transfer zone 93, the embryonic web 88 is transferred to a foraminous carrier fabric 96 by the action of vacuum transfer box 97. Carrier fabric 96 carries the web from the transfer zone 93 past vacuum dewatering box 98, through blow-through predryers 100 and past two turning rolls 101 after which the web is transferred to a Yankee dryer 108 by the action of pressure roll 102. The carrier fabric 96 is then cleaned and dewatered as it completes its loop by passing over and around additional turning rolls 101, showers 103, and vacuum dewatering box 105. The predried paper web is adhesively secured to the cylindrical surface of Yankee dryer 108 aided by adhesive applied by spray applicator 109. Drying is completed on the steam heated Yankee dryer 108 and by hot air which is heated and circulated through drying hood 110 by means not shown. The web is then dry creped from the Yankee dryer 108 by doctor blade 111 after which it is designated paper sheet 70 comprising a Yankee-side layer 71 a center layer 73, and an off-Yankee-side layer 75. Paper sheet 70 then passes between calendar rolls 112 and 113, about a circumferential portion of reel 115, and thence is wound into a roll 116 on a core 117 disposed on shaft 118.

Still referring to FIG. 2, the genesis of Yankee-side layer 71 of paper sheet 70 is the furnish pumped through bottom chamber 83 of headbox 81, and which furnish is applied directly to the Fourdrinier wire 85 whereupon it becomes layer 88*c* of embryonic web 88. The genesis of the center layer 73 of paper sheet 70 is the furnish delivered through chamber 82.5 of headbox 81, and which furnish forms layer 88*b* on top of layer 88*c*. The genesis of the off-Yankee-side layer 75 of paper sheet 70 is the furnish delivered through top chamber 82 of headbox 81, and which furnish forms layer 88*a* on top of layer 88*b* of embryonic web 88. Although FIG. 2 shows papermachine 80 having headbox 81 adapted to make a three-layer web, headbox 81 may alternatively be adapted to make unlayered, two layer or other multi-layer webs.

Further, with respect to making paper sheet 70 embodying the present invention on papermaking machine 80, FIG. 2, the Fourdrinier wire 85 must be of a fine mesh having relatively small spans with respect to the average lengths of the fibers constituting the short fiber furnish so that good formation will occur; and the foraminous carrier fabric 96 should have a fine mesh having relatively small opening spans with respect to the average lengths of the fibers constituting the long fiber furnish to substantially obviate bulking the fabric side of the embryonic web into the inter-filamentary spaces of the fabric 96. Also, with respect to the process conditions for making exemplary paper sheet 70, the paper web is preferably dried to about 80% fiber consistency, and more preferably to about 95% fiber consistency prior to creping.

The present invention is applicable to creped tissue paper in general, including but not limited to conventionally felt-pressed creped tissue paper; high bulk pattern densified creped tissue paper; and high bulk, uncompacted creped tissue paper.

The filled creped tissue paper webs of the present invention have a basis weight of between 10 g/m$^2$ and about 100 g/m$^2$. In its preferred embodiment, the filled tissue paper of the present invention has a basis weight between about 10 g/m$^2$ and about 50 g/m$^2$ and, most preferably, between about 10 g/m$^2$ and about 30 g/m$^2$. Creped tissue paper webs suitable for the present invention possess a density of about 0.60 g/cm$^3$ or less. In its preferred embodiment, the filled tissue paper of the present invention has a density between about 0.03 g/cm$^3$ and about 0.6 g/cm$^3$ and, most preferably, between about 0.05 g/cm$^3$ and 0.2 g/cm$^3$.

The present invention is further applicable to multi-layered tissue paper webs. Tissue structures formed from layered paper webs are described in U.S. Pat. No. 3,994,771, Morgan, Jr. et al. issued Nov. 30, 1976, U.S. Pat. No. 4,300,981, Carstens, issued Nov. 17, 1981, U.S. Pat. No. 4,166,001, Dunning et al., issued Aug. 28, 1979, and European Patent Publication No. 0 613 979 A1, Edwards et al., published Sep. 7, 1994, all of which are incorporated herein by reference. The layers are preferably comprised of different fiber types, the fibers typically being relatively long softwood and relatively short hardwood fibers as used in multi-layered tissue paper making. Multi-layered tissue paper webs suitable for the present invention comprise at least two superposed layers, an inner layer and at least one outer layer contiguous with the inner layer. Preferably, the multi-layered tissue papers comprise three superposed layers, an inner or center layer, and two outer layers, with the inner layer located between the two outer layers. The two outer layers preferably comprise a primary filamentary constituent of relatively short paper making fibers having an average fiber length between about 0.5 and about 1.5 mm, preferably less than about 1.0 mm. These short paper making fibers typically comprise hardwood fibers, preferably hardwood Kraft fibers, and most preferably derived from eucalyptus. The inner layer preferably comprises a primary filamentary constituent of relatively long paper making fibers having an average fiber length of least about 2.0 mm. These long paper making fibers are typically softwood fibers, preferably, northern softwood Kraft fibers. Preferably, the majority of the particulate filler of the present invention is contained in at least one of the outer layers of the multilayered tissue paper web of the present invention. More preferably, the majority of the particulate filler of the present invention is contained in both of the outer layers.

The creped tissue paper products made from single-layered or multi-layered creped tissue paper webs can be single-ply tissue products or multi-ply tissue products.

The advantages related to the practice of the present invention include the ability to reduce the amount of papermaking fibers required to produce a given amount of tissue paper product. Further, the optical properties, particularly the opacity, of the tissue product are improved. These advantages are realized in a tissue paper web which has a high level of strength and is low dusting.

The term "opacity" as used herein refers to the resistance of a tissue paper web from transmitting light of a wavelength corresponding to the visible portion of the electromagnetic spectrum. The "specific opacity" is the measure of the degree of opacity imparted for each 1 g/m$^2$ unit of basis weight of a tissue paper web. The method of measuring opacity and calculating specific opacity are detailed in a later section of this specification. Tissue paper webs according to the present invention preferably have more than about 5%, more preferably more than about 5.5%, and most preferably more than about 6% specific opacity.

The term "strength" as used herein refers to the specific total tensile strength, the determination method for this measure is included in a later section of this specification. The tissue paper webs according to the present invention are strong. This generally means that their specific total tensile strength is at least about 0.25 meters, more preferably more than about 0.40 meters.

The terms "lint" and "dust" are used interchangeably herein and refer to the tendency of a tissue paper web to release fibers or particulate fillers as measured in a controlled abrasion test, the methodology for which is detailed in a later section of this specification. Lint and dust are related to strength since the tendency to release fibers or particles is directly related to the degree to which such fibers or particles are anchored into the structure. As the overall level of anchoring is increased, the strength will be increased. However, it is possible to have a level of strength which is regarded as acceptable but have an unacceptable level of linting or dusting. This is because linting or dusting can be localized. For example, the surface of a tissue paper web can be prone to linting or dusting, while the degree of bonding beneath the surface can be sufficient to raise the overall level of strength to quite acceptable levels. In another case, the strength can be derived from a skeleton of relatively long papermaking fibers, while fiber fines or the particulate filler can be insufficiently bound within the structure. The filled tissue paper webs according to the present invention are relatively low in lint. Levels of lint below about 12 are preferable, below about 10 are more preferable, and below 8 are most preferable.

The multi-layered tissue paper web of this invention can be used in any application where soft, absorbent multi-layered tissue paper webs are required. Particularly advantageous uses of the multi-layered tissue paper web of this invention are in toilet tissue and facial tissue products. Both single-ply and multi-ply tissue paper products can be produced from the webs of the present invention.

Analytical and Testing Procedures

A. Density

The density of multi-layered tissue paper, as that term is used herein, is the average density calculated as the basis weight of that paper divided by the caliper, with the appropriate unit conversions incorporated therein. Caliper of the multi-layered tissue paper, as used herein, is the thickness of the paper when subjected to a compressive load of 95 g/in$^2$ (15.5 g/cm$^2$).

B. Molecular Weight Determination

The essential distinguishing characteristic of polymeric materials is their molecular size. The properties which have enabled polymers to be used in a diversity of applications derive almost entirely from their macro-molecular nature. In order to characterize fully these materials it is essential to have some means of defining and determining their molecular weights and molecular weight distributions. It is more correct to use the term relative molecular mass rather the molecular weight, but the latter is used more generally in polymer technology. It is not always practical to determine molecular weight distributions. However, this is becoming more common practice using chromatographic techniques. Rather, recourse is made to expressing molecular size in terms of molecular weight avenges.

Molecular Weight Averages

If we consider a simple molecular weight distribution which represents the weight fraction ($w_i$) of molecules having relative molecular mass ($M_i$), it is possible to define several useful avenge values. Avenging carried out on the basis of the number of molecules ($N_i$) of a particular size ($M_i$) gives the Number Avenge Molecular Weight $$\overline{M}_n = \frac{\Sigma N_i M_i}{\Sigma Ni}$$

An important consequence of this definition is that the Number Avenge Molecular Weight in grams contains Avogadro's Number of molecules. This definition of molecular weight is consistent with that of monodisperse molecular species, i.e. molecules having the same molecular weight. Of more significance is the recognition that if the number of molecules in a given mass of a polydisperse polymer can be determined in some way then $_n$, can be calculated readily. This is the basis of colligative property measurements.

Averaging on the basis of the weight fractions ($W_i$) of molecules of a given mass ($M_i$) leads to the definition of Weight Avenge Molecular Weights $$\overline{M}_w = \frac{\Sigma W_i N_i}{\Sigma W_i} = \frac{\Sigma N_i M_i^2}{\Sigma N_i M_i}$$

$_w$ is a more useful means for expressing polymer molecular weights than $_n$ since it reflects more accurately such properties as melt viscosity and mechanical properties of polymers and is therefor used in the present invention.

C. Filler Particle Size Determination

Particle size is an important determinant of performance of filler, especially as it relates to the ability to retain it in a paper sheet. Clay particles, in particular, are platy or blocky, not spherical, but a measure referred to as "equivalent spherical diameter" can be used as a relative measure of odd shaped particles and this is one of the main methods that the industry uses to measure the particle size of clays and other particulate fillers. Equivalent spherical diameter determinations of fillers can be made using TAPPI Useful Method 655, which is based on the Sedigraph® analysis, i.e., by the instrument of such type available from the Micromeritics Instrument Corporation of Norcross, Ga. The instrument uses soft x-rays to determine gravity sedimentation rate of a dispersed slurry of particulate filler and employs Stokes Law to calculate the equivalent spherical diameter.

D. Filler Quantitative Analysis in Paper

Those skilled in the an will recognize that there are many methods for quantitative analysis of non-cellulosic filler materials in paper. To aid in the practice of this invention, two methods will be detailed applicable to the most preferred inorganic type fillers. The first method, ashing, is applicable to inorganic fillers in general. The second method, determination of kaolin by XRF, is tailored specifically to the filler found particularly suitable in the practice of the present invention, i.e. kaolin.

Ashing

Ashing is performed by use of a muffle furnace. In this method, a four place balance is first cleaned, calibrated and tarred. Next, a clean and empty platinum dish is weighed on the pan of the four place balance. Record the weight of the empty platinum dish in units of grams to the ten-thousandths place. Without re-tarring the balance, approximately 10 grams of the filled tissue paper sample is carefully folded into the platinum dish. The weight of the platinum boat and paper is recorded in units of grams to the ten-thousandths place.

The paper in the platinum dish is then pre-ashed at low temperatures with a Bunsen burner flame. Care must be taken to do this slowly to avoid the formation of air-borne ash. If air-borne ash is observed, a new sample must be prepared. After the flame from this pre-ashing step has subsided, place the sample in the muffle furnace. The muffle furnace should be at a temperature of 575° C. Allow the sample to completely ash in the muffle furnace for approximately 4 hours. After this time, remove the sample with thongs and place on a clean, flame retardant surface. Allow the sample to cool for 30 minutes. After cooling, weigh the platinum dish/ash combination in units of grams to the ten-thousandths place. Record this weight.

The ash content in the filled tissue paper is calculated by subtracting the weight of the clean, empty platinum dish from the weight of the platinum dish/ash combination. Record this ash content weight in units of grams to the ten-thousandths place.

The ash content weight may be converted to a filler weight by knowledge of the filler loss on ashing (due for example to water vapor loss in kaolin). To determine this, first weigh a clean and empty platinum dish on the pan of a four place balance. Record the weight of the empty platinum dish in units of grams to the ten-thousandths place. Without re-tarring the balance, approximately 3 grams of the filler is carefully poured into the platinum dish. The weight of the platinum dish/filler combination is recorded in units of grams to the ten-thousandths place.

This sample is then carefully placed in the muffle furnace at 575° C. Allow the sample to completely ash in the muffle furnace for approximately 4 hours. After this time, remove the sample with thongs and place on a clean, flame retardant surface. Allow the sample to cool for 30 minutes. After cooling, weigh the platinum dish/ash combination in units of grams to the ten-thousandths place. Record this weight.

Calculate the percent loss on ashing in the original filler sample using the following equation:

$$\text{\% Loss on ashing} = \frac{[(\text{Wt. of Original Filler Sample\&}pt\text{ dish}) - (\text{Wt. of Filler Ash\&}pt\text{ dish})] \times 100}{[(\text{Wt. of Original Filler Sample\&}pt\text{ dish}) - (\text{Wt of }pt\text{ dish})]}$$

The % loss on ashing in kaolin is 10 to 15%. The original ash weight in units of grams can then be converted to a filler weight in units of grams with the following equation:

$$\text{Weight of Filler (g)} = \frac{\text{Weight of Ash (g)}}{[1 - (\text{\% Loss on Ashing}/100)]}$$

The percent filler in the original filled tissue paper can then be calculated as follows:

$$\text{\% Filler in Tissue Paper} = \frac{\text{Weight of Filler (g)} \times 100}{[(\text{Weight of Platinum Dish\&Paper}) - (\text{Weight of Platinum Dish})]}$$

Determination of Kaolin Clay by XRF

The main advantage of the XRF technique over the muffle furnace ashing technique is speed, but it is not as universally applicable. The XRF spectrometer can quantitate the level of kaolin clay in a paper sample within 5 minutes compared to the hours it takes in the muffle furnace ashing method.

The X-ray Fluorescence technique is based on the bombardment of the sample of interest with X-ray photons from a X-ray tube source. This bombardment by high energy photons causes core level electrons to be photoemitted by the elements present in the sample. These empty core levels are then filled by outer shell electrons. This filling by the outer shell electrons results in the fluorescence process such that additional X-ray photons are emitted by the elements present in the sample. Each element has distinct "fingerprint" energies for these X-ray fluorescent transitions. The energy and thus the identity of the element of interest of these emitted X-ray fluorescence photons is determined with a lithium doped silicon semiconductor detector. This detector makes it possible to determine the energy of the impinging photons and thus the identify the elements present in the sample. The elements from sodium to uranium may be identified in most sample matrices.

In the case of the clay fillers, the detected elements are both silicon and aluminum. The particular X-ray Fluorescence instrument used in this clay analysis is a Spectrace 5000 made by Baker-Hughes Inc. of Mountain View, Calif. The first step in the quantitative analysis of clay is to calibrate the instrument with a set of known clay filled tissue standards, using clay inclusions ranging from 8% to 20%, for example.

The exact clay level in these standard paper samples is determined with the muffle furnace ashing technique described above. A blank paper sample is also included as one of the standards. At least 5 standards bracketing the desired target day level should be used to calibrate the instrument.

Before the actual calibration process, the X-ray tube is powered to settings of 13 kilovolts and 0.20 milliamps. The instrument is also set up to integrate the detected signals for the aluminum and silicon contained in the clay. The paper sample is prepared by first cutting a 2" by 4" strip. This strip is then folded to make a 2"×2" with the off-Yankee side facing out. This sample is placed on top of the sample cup and held in place with a retaining ring. During sample preparation, care must be taken to keep the sample fiat on top of the sample cup. The instrument is then calibrated using this set of known standards.

After calibrating the instrument with the set of known standards, the linear calibration curve is stored in the computer system's memory. This linear calibration curve is used to calculate clay levels in the unknowns. To insure the X-ray Fluorescence system is stable and working properly, a check sample of known clay content is run with every set of unknowns. If the analysis of the check sample results in an inaccurate result (10 to 15% off from its known day content), the instrument is subjected to trouble-shooting and/or re-calibrated.

For every paper-making condition, the clay content in at least 3 unknown samples is determined. The average and standard deviation is taken for these 3 samples. If the day application procedure is suspected or intentionally set up to vary the clay content in either the cross direction (CD) or machine direction (MD) of the paper, more samples should be measured in these CD and MD directions.

E. Measurement of Tissue Paper Lint

The amount of lint generated from a tissue product is determined with a Sutherland Rub Tester. This tester uses a motor to rub a weighted felt 5 times over the stationary toilet tissue. The Hunter Color L value is measured before and after the rub test. The difference between these two Hunter Color L values is calculated as lint.

SAMPLE PREPARATION:

Prior to the lint rub testing, the paper samples to be tested should be conditioned according to Tappi Method #T402OM-88. Here, samples are preconditioned for 24 hours at a relative humidity level of 10 to 35% and within a temperature range of 22° to 40° C. After this preconditioning step, samples should be conditioned for 24 hours at a relative humidity of 48 to 52% and within a temperature range of 22° to 24° C. This rub testing should also take place within the confines of the constant temperature and humidity room.

The Sutherland Rub Tester may be obtained from Testing Machines, Inc. (Amityville, N.Y. 11701). The tissue is first prepared by removing and discarding any product which might have been abraded in handling, e.g. on the outside of the roll. For multi-ply finished product, three sections with each containing two sheets of multi-ply product are removed and set on the bench-top. For single-ply product, six sections with each containing two sheets of single-ply product are removed and set on the bench-top. Each sample is then folded in half such that the crease is running along the cross direction (CD) of the tissue sample. For the multi-ply product, make sure one of the sides facing out is the same side facing out after the sample is folded. In other words, do not tear the plies apart from one another and rub test the sides facing one another on the inside of the product. For the single-ply product, make up 3 samples with the off-Yankee side out and 3 with the Yankee side out. Keep track of which samples are Yankee side out and which are off-Yankee side out.

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.5"×6". Puncture two holes into each of the six cards by forcing the cardboard onto the hold down pins of the Sutherland Rub tester.

If working with single-ply finished product, center and carefully place each of the 2.5"×6" cardboard pieces on top of the six previously folded samples. Make sure the 6" dimension of the cardboard is running parallel to the machine direction (MD) of each of the tissue samples. If working with multi-ply finished product, only three pieces of the 2.5"×6" cardboard will be required. Center and carefully place each of the cardboard pieces on top of the three previously folded samples. Once again, make sure the 6" dimension of the cardboard is running parallel to the machine direction (MD) of each of the tissue samples.

Fold one edge of the exposed portion of tissue sample onto the back of the cardboard. Secure this edge to the cardboard with adhesive tape obtained from 3M Inc. (¾" wide Scotch Brand, St. Paul, Minn. Carefully grasp the other over-hanging tissue edge and snugly fold it over onto the back of the cardboard. While maintaining a snug fit of the paper onto the board, tape this second edge to the back of the cardboard. Repeat this procedure for each sample.

Turn over each sample and tape the cross direction edge of the tissue paper to the cardboard. One half of the adhesive tape should contact the tissue paper while the other half is adhering to the cardboard. Repeat this procedure for each of the samples. If the tissue sample breaks, tears, or becomes frayed at any time during the course of this sample preparation procedure, discard and make up a new sample with a new tissue sample strip.

If working with multi-ply Convened product, there will now be 3 samples on the cardboard. For single-ply finished product, there will now be 3 off-Yankee side out samples on cardboard and 3 Yankee side out samples on cardboard.

FELT PREPARATION:

Obtain a 30"×40" piece of Crescent #300 cardboard from Cordage Inc. (800 E. Ross Road, Cincinnati, Ohio, 45217). Using a paper cutter, cut out six pieces of cardboard of dimensions of 2.25"×7.25". Draw two lines parallel to the short dimension and down 1.125" from the top and bottom most edges on the white side of the cardboard. Carefully score the length of the line with a razor blade using a straight edge as a guide. Score it to a depth about half way through the thickness of the sheet. This scoring allows the cardboard/felt combination to fit tightly around the weight of the Sutherland Rub tester. Draw an arrow running parallel to the long dimension of the cardboard on this scored side of the cardboard.

Cut the six pieces of black felt (F-55 or equivalent from New England Gasket, 550 Broad Street, Bristol, Conn. 06010) to the dimensions of 2.25"×8.5"×0.0625." Place the felt on top of the unscored, green side of the cardboard such that the long edges of both the felt and cardboard are parallel and in alignment. Make sure the fluffy side of the felt is facing up. Also allow about 0.5" to overhang the top and bottom most edges of the cardboard. Snugly fold over both overhanging felt edges onto the backside of the cardboard with Scotch brand tape. Prepare a total of six of these felt/cardboard combinations.

For best reproducibility, all samples should be run with the same lot of felt. Obviously, there are occasions where a single lot of felt becomes completely depleted. In those cases where a new lot of felt must be obtained, a correction factor should be determined for the new lot of felt. To determine the correction factor, obtain a representative single tissue sample of interest, and enough felt to make up 24 cardboard/felt samples for the new and old lots.

As described below and before any rubbing has taken place, obtain Hunter L readings for each of the 24 cardboard/felt samples of the new and old lots of felt. Calculate the averages for both the 24 cardboard/felt samples of the old lot and the 24 cardboard/felt samples of the new lot.

Next, rub test the 24 cardboard/felt boards of the new lot and the 24 cardboard/felt boards of the old lot as described below. Make sure the same tissue lot number is used for each of the 24 samples for the old and new lots. In addition, sampling of the paper in the preparation of the cardboard/tissue samples must be done so the new lot of felt and the old lot of felt are exposed to as representative as possible of a tissue sample. For the case of 1-ply tissue product, discard any product which might have been damaged or abraded. Next, obtain 48 strips of tissue each two usable units (also termed sheets) long. Place the first two usable unit strip on the far left of the lab bench and the last of the 48 samples on the far right of the bench. Mark the sample to the far left with the number "1" in a 1 cm by 1 cm area of the corner of the sample. Continue to mark the samples consecutively up to 48 such that the last sample to the far right is numbered 48.

Use the 24 odd numbered samples for the new felt and the 24 even numbered samples for the old felt. Order the odd number samples from lowest to highest. Order the even numbered samples from lowest to highest. Now, mark the lowest number for each set with a letter "Y." Mark the next highest number with the letter "O." Continue marking the samples in this alternating "Y"/"O" pattern. Use the "Y" samples for Yankee side out lint analyses and the "O" samples for off-Yankee side lint analyses. For 1-ply product, there are now a total of 24 samples for the new lot of felt and the old lot of felt. Of this 24, twelve are for Yankee side out lint analysis and 12 are for off-Yankee side lint analysis.

Rub and measure the Hunter Color L values for all 24 samples of the old felt as described below. Record the 12 Yankee side Hunter Color L values for the old felt. Average the 12 values. Record the 12 off-Yankee side Hunter Color L values for the old felt. Average the 12 values. Subtract the average initial un-rubbed Hunter Color L felt reading from the average Hunter Color L reading for the Yankee side rubbed samples. This is the delta average difference for the Yankee side samples. Subtract the average initial un-rubbed Hunter Color L felt reading from the average Hunter Color L reading for the off-Yankee side rubbed samples. This is the delta average difference for the off-Yankee side samples. Calculate the sum of the delta average difference for the Yankee-side and the delta average difference for the off-Yankee side and divide this sum by 2. This is the uncorrected lint value for the old felt. If there is a current felt correction factor for the old felt, add it to the uncorrected lint value for the old felt. This value is the corrected Lint Value for the old felt.

Rub and measure the Hunter Color L values for all 24 samples of the new felt as described below. Record the 12 Yankee side Hunter Color L values for the new felt. Average the 12 values. Record the 12 off-Yankee side Hunter Color L values for the new felt. Average the 12 values. Subtract the average initial un-rubbed Hunter Color L felt reading from the average Hunter Color L reading for the Yankee side rubbed samples. This is the delta average difference for the Yankee side samples. Subtract the average initial un-rubbed Hunter Color L felt reading from the average Hunter Color L reading for the off-Yankee side rubbed samples. This is the delta average difference for the off-Yankee side samples. Calculate the sum of the delta average difference for the Yankee-side and the delta average difference for the off-Yankee side and divide this sum by 2. This is the uncorrected lint value for the new felt.

Take the difference between the corrected Lint Value from the old felt and the uncorrected lint value for the new felt. This difference is the felt correction factor for the new lot of felt.

Adding this felt correction factor to the uncorrected lint value for the new felt should be identical to the corrected Lint Value for the old felt.

The same type procedure is applied to two-ply tissue product with 24 samples run for the old felt and 24 run for the new felt. But, only the consumer used outside layers of the plies are rub tested. As noted above, make sure the samples are prepared such that a representative sample is obtained for the old and new felts.

CARE OF 4 POUND WEIGHT:

The four pound weight has four square inches of effective contact area providing a contact pressure of one pound per square inch. Since the contact pressure can be changed by alteration of the rubber pads mounted on the face of the weight, it is important to use only the rubber pads supplied by the manufacturer (Brown Inc., Mechanical Services Department, Kalamazoo, Mich.). These pads must be replaced if they become hard, abraded or chipped off.

When not in use, the weight must be positioned such that the pads are not supporting the full weight of the weight. It is best to store the weight on its side.

RUB TESTER INSTRUMENT CALIBRATION:

The Sutherland Rub Tester must first be calibrated prior to use. First, turn on the Sutherland Rub Tester by moving the tester switch to the "cont" position. When the tester arm is in its position closest to the user, turn the tester's switch to the "auto" position. Set the tester to run 5 strokes by moving the pointer arm on the large dial to the "five" position setting. One stroke is a single and complete forward and reverse motion of the weight. The end of the rubbing block should be in the position closest to the operator at the beginning and at the end of each test.

Prepare a tissue paper on cardboard sample as described above. In addition, prepare a felt on cardboard sample as described above. Both of these samples will be used for calibration of the instrument and will not be used in the acquisition of data for the actual samples.

Place this calibration tissue sample on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface. Activate the tester by depressing the "push" button.

Keep a count of the number of strokes and observe and make a mental note of the starting and stopping position of the felt covered weight in relationship to the sample. If the total number of strokes is five and if the end of the felt covered weight closest to the operator is over the cardboard of the tissue sample at the beginning and end of this test, the tester is calibrated and ready to use. If the total number of strokes is not five or if the end of the felt covered weight closest to the operator is over the actual paper tissue sample either at the beginning or end of the test, repeat this calibration procedure until 5 strokes are counted the end of the felt covered weight closest to the operator is situated over the cardboard at the both the start and end of the test.

During the actual testing of samples, monitor and observe the stroke count and the starting and stopping point of the felt covered weight. Recalibrate when necessary.

HUNTER COLOR METER CALIBRATION:

Adjust the Hunter Color Difference Meter for the black and white standard plates according to the procedures outlined in the operation manual of the instrument. Also run the stability check for standardization as well as the daily color stability check if this has not been done during the past eight hours. In addition, the zero reflectance must be checked and readjusted if necessary.

Place the white standard plate on the sample stage under the instrument port. Release the sample stage and allow the sample plate to be raised beneath the sample port.

Using the "L-Y", "a-X", and "b-Z" standardizing knobs, adjust the instrument to read the Standard White Plate Values of "L", "a", and "b" when the "L", "a", and "b" push buttons are depressed in turn.

MEASUREMENT OF SAMPLES:

The first step in the measurement of lint is to measure the Hunter color values of the black felt/cardboard samples prior to being rubbed on the toilet tissue. The first step in this measurement is to lower the standard white plate from under the instrument port of the Hunter color instrument. Center a felt covered cardboard, with the arrow pointing to the back of the color meter, on top of the standard plate. Release the sample stage, allowing the felt covered cardboard to be raised under the sample port.

Since the felt width is only slightly larger than the viewing area diameter, make sure the felt completely covers the viewing area. After confirming complete coverage, depress the L push button and wait for the reading to stabilize. Read and record this L value to the nearest 0.1 unit.

If a D25D2A head is in use, lower the felt covered cardboard and plate, rotate the felt covered cardboard 90 degrees so the arrow points to the right side of the meter. Next, release the sample stage and check once more to make sure the viewing area is completely covered with felt. Depress the L push button. Read and record this value to the nearest 0.1 unit. For the D25D2M unit, the recorded value is the Hunter Color L value. For the D25D2A head where a rotated sample reading is also recorded, the Hunter Color L value is the average of the two recorded values.

Measure the Hunter Color L values for all of the felt covered cardboards using this technique. If the Hunter Color L values are all within 0.3 units of one another, take the average to obtain the initial L reading. If the Hunter Color L values are not within the 0.3 units, discard those felt/cardboard combinations outside the limit. Prepare new samples and repeat the Hunter Color L measurement until all samples are within 0.3 units of one another.

For the measurement of the actual tissue paper/cardboard combinations, place the tissue sample/cardboard combination on the base plate of the tester by slipping the holes in the board over the hold-down pins. The hold-down pins prevent the sample from moving during the test. Clip the calibration felt/cardboard sample onto the four pound weight with the cardboard side contacting the pads of the weight. Make sure the cardboard/felt combination is resting flat against the weight. Hook this weight onto the tester arm and gently place the tissue sample underneath the weight/felt combination. The end of the weight closest to the operator must be over the cardboard of the tissue sample and not the tissue sample itself. The felt must rest flat on the tissue sample and must be in 100% contact with the tissue surface.

Next, activate the tester by depressing the "push" button. At the end of the five strokes the tester will automatically stop. Note the stopping position of the felt covered weight in relation to the sample. If the end of the felt covered weight toward the operator is over cardboard, the tester is operating properly. If the end of the felt covered weight toward the operator is over sample, disregard this measurement and recalibrate as directed above in the Sutherland Rub Tester Calibration section.

Remove the weight with the felt covered cardboard. Inspect the tissue sample. If torn, discard the felt and tissue and start over. If the tissue sample is intact, remove the felt covered cardboard from the weight. Determine the Hunter Color L value on the felt covered cardboard as described above for the blank felts. Record the Hunter Color L readings for the felt after rubbing. Rub, measure, and record the Hunter Color L values for all remaining samples.

After all tissues have been measured, remove and discard all felt. Felts strips are not used again. Cardboards are used until they are bent, torn, limp, or no longer have a smooth surface.

CALCULATIONS:

Determine the delta L values by subtracting the average initial L reading found for the unused felts from each of the measured values for the Off-Yankee and Yankee sides of the sample. Recall, multi-ply-ply product will only rub one side of the paper. Thus, three delta L values will be obtained for the multi-ply product. Average the three delta L values and subtract the felt factor from this final average. This final result is termed the lint for the fabric side of the 2-ply product.

For the single-ply product where both Yankee side and off-Yankee side measurements are obtained, subtract the average initial L reading found for the unused felts from each of the three Yankee side L readings and each of the three off-Yankee side L readings. Calculate the average delta for the three Yankee side values. Calculate the average delta for the three fabric side values. Subtract the felt factor from each of these averages. The final results are termed a lint for the fabric side and a lint for the Yankee side of the single-ply product. By taking the average of these two values, an ultimate lint is obtained for the entire single-ply product.

F. Measurement of Panel Softness of Tissue Papers

Ideally, prior to softness testing, the paper samples to be tested should be conditioned according to Tappi Method #F402OM-88. Here, samples are preconditioned for 24 hours at a relative humidity level of 10 to 35% and within a temperature range of 22° to 40° C. After this preconditioning step, samples should be conditioned for 24 hours at a relative humidity of 48 to 52% and within a temperature range of 22° to 24° C.

Ideally, the softness panel testing should take place within the confines of a constant temperature and humidity room. If this is not feasible, all samples, including the controls, should experience identical environmental exposure conditions.

Softness testing is performed as a paired comparison in a form similar to that described in "Manual on Sensory Testing Methods", ASTM Special Technical Publication 434, published by the American Society For Testing and Materials 1968 and is incorporated herein by reference. Softness is evaluated by subjective testing using what is referred to as a Paired Difference Test. The method employs a standard external to the test material itself. For tactile perceived softness two samples are presented such that the subject cannot see the samples, and the subject is required to choose one of them on the basis of tactile softness. The result of the test is reported in what is referred to as Panel Score Unit (PSU). With respect to softness testing to obtain the softness data reported herein in PSU, a number of softness panel tests are performed. In each test ten practiced softness judges are asked to rate the relative softness of three sets of paired samples. The pairs of samples are judged one pair at a time by each judge: one sample of each pair being designated X and the other Y. Briefly, each X sample is graded against its paired Y sample as follows:

1. A grade of plus one is given if X is judged to may be a little softer than Y, and a grade of minus one is given if Y is judged to may be a little softer than X;
1. A grade of plus two is given if X is judged to surely be a little softer than Y, and a grade of minus two is given if Y is judged to surely be a little softer than X;
3. A grade of plus three is given to X if it is judged to be a lot softer than Y, and a grade of minus three is given if Y is judged to be a lot softer than X; and, lastly:
4. A grade of plus four is given to X if it is judged to be a whole lot softer than Y, and a grade of minus 4 is given if Y is judged to be a whole lot softer than X.

The grades are averaged and the resultant value is in units of PSU. The resulting data are considered the results of one panel test. If more than one sample pair is evaluated then all sample pairs are rank ordered according to their grades by paired statistical analysis. Then, the rank is shifted up or down in value as required to give a zero PSU value to which ever sample is chosen to be the zero-base standard. The other samples then have plus or minus values as determined by their relative grades with respect to the zero base standard. The number of panel tests performed and averaged is such that about 0.2 PSU represents a significant difference in subjectively perceived softness.

G. Measurement of Opacity of Tissue Papers

The percent opacity is measured using a Colorquest DP-9000 Spectrocolorimeter. Locate the on/off switch on the back of the processor and turn it on. Allow the instrument to warm up for two hours. If the system has gone into standby mode, press any key on the key pad and allow the instrument 30 minutes of additional warm-up time.

Standardize the instrument using the black glass and white tile. Make sure the standardization is done in the read mode and according to the instructions given in the standardization section of the DP9000 instrument manual. To standardize the DP-9000, press the CAL key on the processor and follow the prompts as shown on the screen. You are then prompted to read the black glass and the white tile.

The DP-9000 must also be zeroed according the instructions given in the DP-9000 instrument manual. Press the setup key to get into the setup mode. Define the following parameters:

UF filter: OUT

Display: ABSOLUTE

Read Interval: SINGLE
Sample ID: ON or OFF
Average: OFF
Statistics: SKIP
Color Scale: XYZ
Color Index: SKIP
Color Difference Scale: SKIP
Color Difference Index: SKIP
CMC Ratio: SKIP
CMC Commercial Factor: SKIP
Observer: 10 degrees
Illuminant: D
M12nd illuminant: SKIP
Standard: WORKING
Target Values: SKIP
Tolerances: SKIP Confirm the color scale is set to XYZ, the observer set to 10 degrees, and the illuminant set to D. Place the one ply sample on the white uncalibrated tile. The white calibrated tile can also be used. Raise the sample and tile into place under the sample port and determine the Y value.

Lower the sample and tile. Without rotating the sample itself, remove the white tile and replace with the black glass. Again, raise the sample and black glass and determine the Y value. Make sure the 1-ply tissue sample is not rotated between the white tile and black glass readings.

The percent opacity is calculated by taking the ratio of the Y reading on the black glass to the Y reading on the white tile. This value is then multiplied by 100 to obtain the percent opacity value.

For the purposes of this specification, the measure of opacity is converted into a "specific opacity", which, in effect, corrects the opacity for variations in basis weight. The formula to convert opacity % into specific opacity % is as follows:

$$\text{Specific Opacity}=(1-(\text{Opacity}/100)^{(1/\text{Basis Weight})})\times 100,$$

where the specific opacity unit is per cent for each $g/m^2$, opacity is in units of per cent, and basis weight is in units of $g/m^2$.

Specific opacity should be reported to 0.01%.

G. Measurement of Strength of Tissue Papers

DRY TENSILE STRENGTH

The tensile strength is determined on one inch wide strips of sample using a Thwing-Albert Intelect H Standard Tensile Tester (Thwing-Albert Instrument Co., 10960 Dutton Rd., Philadelphia, Pa., 19154). This method is intended for use on finished paper products, reel samples, and unconverted stocks.

SAMPLE CONDITIONING AND PREPARATION:

Prior to tensile testing, the paper samples to be tested should be conditioned according to Tappi Method #F402OM-88. All plastic and paper board packaging materials must be carefully removed from the paper samples prior to testing. The paper samples should be conditioned for at least 2 hours at a relative humidity of 48 to 52% and within a temperature range of 22° to 24° C. Sample preparation and all aspects of the tensile testing should also take place within the confines of the constant temperature and humidity room.

For finished product, discard any damaged product. Next, remove 5 strips of four usable units (also termed sheets) and stack one on top to the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co., 10960 Dutton Road, Philadelphia, Pa., 19154) to make 4 separate stocks. Make sure stacks 1 and 3 are still identified for machine direction testing and stacks 2 and 4 are identified for cross direction testing.

Cut two 1" wide strips in the machine direction from stacks 1 and 3. Cut two 1" wide strips in the cross direction from stacks 2 and 4. There are now four 1" wide strips for machine direction tensile testing and four 1" wide strips for cross direction tensile testing. For these finished product samples, all eight 1" wide strips are five usable units (also termed sheets) thick.

For unconverted stock and/or reel samples, cut a 15" by 15" sample which is 8 plies thick from a region of interest of the sample using a paper cutter (JDC-1-10 or JDC-1-12 with safety shield from Thwing-Albert Instrument Co., 10960 Dutton Road, Philadelphia, Pa., 19154). Make sure one 15" cut runs parallel to the machine direction while the other runs parakeet to the cross direction. Make sure the sample is conditioned for at least 2 hours at a relative humidity of 48 to 52% and within a temperature range of 22° to 24° C. Sample preparation and all aspects of the tensile testing should also take place within the confines of the constant temperature and humidity room.

From this preconditioned 15" by 15" sample which is 8 plies thick, cut four strips 1" by 7" with the long 7" dimension running parallel to the machine direction. Note these samples as machine direction reel or unconverted stock samples. Cut an additional four strips 1" by 7" with the long 7" dimension running parallel to the cross direction. Note these samples as cross direction reel or unconverted stock samples. Make sure all previous cuts are made using a paper cutter (JDC-1-10 or JDC-1-12 with safety shield from Thwing-Albert Instrument Co., 10960 Dutton Road, Philadelphia, Pa., 19154). There are now a total of eight samples: four 1" by 7" strips which are 8 plies thick with the 7" dimension running parallel to the machine direction and four 1" by 7" strips which are 8 plies thick with the 7" dimension running parallel to the cross direction.

OPERATION OF TENSILE TESTER:

For the actual measurement of the tensile strength, use a Thwing-Albert Intelect II Standard Tensile Tester (Thwing-Albert Instrument Co., 10960 Dutton Rd., Philadelphia, Pa., 19154). Insert the flat face clamps into the unit and calibrate the tester according to the instructions given in the operation manual of the Thwing-Albert Intelect II. Set the instrument crosshead speed to 4.00 in/min and the 1st and 2nd gauge lengths to 2.00 inches. The break sensitivity should be set to 20.0 grams and the sample width should be set to 1.00" and the sample thickness at 0.025".

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2–3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

CALCULATIONS:

For the four machine direction 1" wide finished product strips, sum the four individual recorded tensile readings. Divide this sum by the number of strips tested. This number should normally be four. Also divide the sum of recorded tensiles by the number of usable units per tensile strip. This is normally five for both 1-ply and 2-ply products.

Repeat this calculation for the cross direction finished product strips.

For the unconverted stock or reel samples cut in the machine direction, sum the four individual recorded tensile readings. Divide this sum by the number of strips tested. This number should normally be four. Also divide the sum of recorded tensiles by the number of usable units per tensile strip. This is normally eight.

Repeat this calculation for the cross direction unconverted or reel sample paper strips.

All results are in units of grams/inch.

For purposes of this specification, the tensile strength should be converted into a "specific total tensile strength" defined as the sum of the tensile strength measured in the machine and cross machine directions, divided by the basis weight, and corrected in units to a value in meters.

EXAMPLE

The following example is offered to illustrate the practice of the present invention. These examples are intended to aid in the description of the present invention, but, in no way, should be interpreted as limiting the scope thereof. The present invention is bounded only by the appended claims.

Reference Process

This following discussion illustrates a reference process not incorporating the features of the present invention.

First, an aqueous slurry of Northern Softwood Kraft of about 3% consistency is made up using a conventional pulper and is passed through a stock pipe toward the headbox of the Fourdrinier.

In order to impart a temporary wet strength to the finished product, a 1% dispersion of National Starch Co-BOND 1000® is prepared and is added to the NSK stock pipe at a rate sufficient to deliver 1% Co-BOND 1000® based on the dry weight of the NSK fibers. The absorption of the temporary wet strength resin is enhanced by passing the treated slurry through an in-line mixer.

The NSK slurry is diluted with white water to about 0.2% consistency at the fan pump.

An aqueous slurry of eucalyptus fibers of about 3% by weight is made up using a conventional repulper.

The eucalyptus is passed through a stock pipe to another fan pump where it is diluted with white water to a consistency of about 0.2%.

The slurries of NSK and eucalyptus are directed into a multi-channeled headbox suitably equipped with layering leaves to maintain the streams as separate layers until discharge onto a traveling Fourdrinier wire. A three-chambered headbox is used. The eucalyptus slurry containing 80% of the dry weight of the ultimate paper is directed to chambers leading to each of the two outer layers, while the NSK slurry comprising 20% of the dry weight of the ultimate paper is directed to a chamber leading to a layer between the two eucalyptus layers. The NSK and eucalyptus slurries are combined at the discharge of the headbox into a composite slurry.

The composite slurry is discharged onto the traveling Fourdrinier wire and is dewatered assisted by a deflector and vacuum boxes.

The embryonic wet web is transferred from the Fourdrinier wire, at a fiber consistency of about 15% at the point of transfer, to a patterned forming fabric of a 5-shed, satin weave configuration having 84 machine-direction and 76 cross-machine-direction monofilaments per inch, respectively, and about 36% knuckle area.

Further de-watering is accomplished by vacuum assisted drainage until the web has a fiber consistency of about 28%.

While remaining in contact with the patterned forming fabric, the patterned web is pre-dried by air blow-through to a fiber consistency of about 62% by weight.

The semi-dry web is then adhered to the surface of a Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web.

The fiber consistency is increased to about 96% before the web is dry creped from the Yankee with a doctor blade.

The doctor blade has a bevel angle of about 25 degrees and is positioned with respect to the Yankee dryer to provide an impact angle of about 81 degrees.

The percent crepe is adjusted to about 18% by operating the Yankee dryer at about 800 fpm (feet per minute) (about 244 meters per minute), while the dry web is formed into roll at a speed of 656 fpm (201 meters per minutes).

The web is convened into a three-layer, single-ply creped patterned densified tissue paper product of about 18 lb per 3000 $ft^2$ basis weight.

Process According to the Present Invention

This discussion illustrates preparation of a filled tissue paper exhibiting one embodiment of the present invention.

An aqueous slurry of eucalyptus fibers of about 3% by weight is made up using a conventional repulper. The eucalyptus is passed through a refiner where its freeness is decreased from about 640 CSF to about 500 CSF. It then is carried through a stock pipe toward the papermachine.

The particulate filler is kaolin clay, grade WW Fil SD®, made by Dry Branch Kaolin of Dry Branch, Ga. It is first made down to an aqueous slurry by mixing it with water to a consistency of about 1% solids. It is then carried through a stock pipe where it is mixed with a cationic starch, RediBOND 5327®, which is delivered as a 1% dispersion in water. RediBOND 5327® is a predispersed form of waxy maize corn starch. It is added at a rate equivalent to about 0.5% based on the amount of solid weight of the starch per solid weight of the filler. The adsorption of the cationic starch is promoted by passing the mixture through an in-line mixer. This forms an agglomerated suspension of filler particles.

The agglomerated suspension of filler particles is then mixed into the stock pipe carrying the refined eucalyptus fibers and the final mixture is diluted with white water at the inlet of a fan pump to a consistency of about 0.2% based on the weight of the solid filler particles and eucalyptus fibers. After the fan pump carrying the combination of agglomerated filler particles and eucalyptus fibers, Reten 1232, a cationic flocculant is added to the mixture at a rate corresponding to 0.067% based on the solids weight of the filler and eucalyptus fiber.

An aqueous slurry of NSK of about 3% consistency is made up using a conventional pulper and is passed through a stock pipe toward the headbox of the Fourdrinier.

In order to impart a temporary wet strength to the finished product, a 1% dispersion of National Starch Co-BOND 1000® is prepared and is added to the NSK stock pipe at a rate sufficient to deliver 1% Co-BOND 1000® based on the dry weight of the NSK fibers. The absorption of the temporary wet strength resin is enhanced by passing the treated slurry through an in-line mixer.

The NSK slurry is diluted with white water to about 0.2% consistency at the fan pump. After the fan pump, RETEN 1232®, a cationic flocculant is added at a rate corresponding to 0.067% based on the dry weight of the NSK fiber.

The slurries of NSK and eucalyptus are directed into a multi-channeled headbox suitably equipped with layering leaves to maintain the streams as separate layers until discharge onto a traveling Fourdrinier wire. A three-chambered headbox is used. The combined eucalyptus and particulate filler slurry contain sufficient solids flow to achieve 80% of the dry weight of the ultimate paper. This combined slurry is directed to chambers leading to each of the two outer layers, while the NSK slurry comprising sufficient solids flow to achieve 20% of the dry weight of the ultimate paper is directed to a chamber: leading to a layer between the two eucalyptus layers. The NSK and eucalyptus slurries are combined at the discharge of the headbox into a composite slurry.

The composite slurry is discharged onto the traveling Fourdrinier wire and is dewatered assisted by a deflector and vacuum boxes.

The embryonic wet web is transferred from the Fourdrinier wire, at a fiber consistency of about 15% at the point of transfer, to a patterned forming fabric of a 5-shed, satin weave configuration having 84 machine-direction and 76 cross-machine-direction monofilaments per inch, respectively, and about 36% knuckle Further de-watering is accomplished by vacuum assisted drainage until the web has a fiber consistency of about 28%.

While remaining in contact with the patterned forming fabric, the patterned web is pre-dried by air blow-through to a fiber consistency of about 62% by weight.

The semi-dry web is then adhered to the surface of a Yankee dryer with a sprayed creping adhesive comprising a 0.125% aqueous solution of polyvinyl alcohol. The creping adhesive is delivered to the Yankee surface at a rate of 0.1% adhesive solids based on the dry weight of the web.

The fiber consistency is increased to about 96% before the web is dry creped from the Yankee with a doctor blade.

The doctor blade has a bevel angle of about 20 degrees and is positioned with respect to the Yankee dryer to provide an impact angle of about 76 degrees.

The percent crepe is adjusted to about 18% by operating the Yankee dryer at about 800 fpm (feet per minute) (about 244 meters per minute), while the dry web is formed into roll at a speed of 656 fpm (200 meters per minutes).

The web is converted into a three-layer, single-ply creped patterned densified tissue paper product of about 18 lb per 3000 $ft^2$ basis weight.

| | Reference | Present Invention |
|---|---|---|
| Kaolin content % | None | 13.3 |
| Kaolin Retention (Overall) % | NA | 74 |
| Tensile Strength (g/in) | 400 | 396 |
| Specific Opacity % | 5.2 | 5.8 |
| Ultimate Lint Number | 7.0 | 6.0 |
| Softness score | 0.0 | −0.03 |

What is claimed is:

1. A process for incorporating a fine non-cellulosic particulate filler into a creped tissue paper, said process comprising the steps of:

a) contacting an aqueous dispersion of a non-cellulosic particulate filler with an aqueous dispersion of starch, b) mixing the aqueous dispersion of starch-contacted filler with papermaking fibers forming an aqueous papermaking furnish comprising starch-contacted filler and papermaking fibers, c) contacting said aqueous papermaking furnish with a flocculant, d) forming an embryonic paper web from the aqueous papermaking furnish on foraminous papermaking clothing, e) removing water from said embryonic web to form a semi-dry papermaking web, f) adhering the semi-dry papermaking web to a Yankee dryer and drying said web to a substantially dry condition, g) creping the substantially dry web from the Yankee dryer by means of a flexible creping blade, thereby forming a creped tissue paper;

wherein said particulate filler comprises from about 1% to about 50% of the total weight of said creped tissue paper, said particulate filler selected from the group consisting of clay, calcium carbonate, titanium dioxide, talc, aluminum silicate, calcium silicate, alumina trihydrate, activated carbon, calcium sulfate, glass microspheres, diatomaceous earth, and mixtures thereof; and wherein said starch comprises from about 0.01% to about 5% by weight based on the weight of said particulate filler.

2. The process of claim 1 wherein said particulate filler is kaolin clay having an average equivalent spherical diameter between about 0.5 m and about 5 m.

3. The process of claim 1 wherein said starch has a degree of substitution ranging from about 0.01 to about 0.1 cationic substituent per anhydroglucose units of starch.

4. The process of claim 3 wherein said cationic substituent is selected from the group consisting of tertiary aminoalkyl ethers, quaternary ammonium alkyl ethers and mixtures thereof.

5. The process of claim 3 wherein in step (a), said aqueous dispersion of particulate filler contains between about 0.1% and about 5% by weight of particulate filler and said aqueous dispersion of starch contains between about 0.1% and about 10% by weight of starch.

6. The process of claim 5 wherein said particulate filler is kaolin clay having an average equivalent spherical diameter between about 0.5 m and about 5 m.

7. The process of claim 1 comprising the additional step of refining the papermaking fibers to a freeness less than about 600 ml Canadian Standard Freeness prior to contact with said particulate filler in step (b).

8. The process of claim 6 comprising the additional step of refining the papermaking fibers to a freeness less than about 600 ml Canadian Standard Freeness prior to contact with said particulate filler in step (b).

9. The process of claim 5 wherein said flocculant contains from about 0.2 to about 2.5 milliequivalents of cationic substituent per gram of polymer.

10. The process of claim 9 wherein said cationic flocculant is a cationic polyacrylamide having a molecular weight of at least about 1,000,000.

11. The process of claim 10 wherein in process step (c) said aqueous papermaking furnish contains less than about 0.5% solids and said aqueous dispersion of flocculant contains less than about 0.3% solids.

12. The process of claim 11 wherein said particulate filler is kaoline clay having an average equivalent spherical diameter between about 0.5μ and about 5μ.

13. A process for incorporating a fine non-cellulosic particulate filler into a multi-layered creped tissue paper, said process comprising the steps of:

a) contacting an aqueous dispersion of a non-cellulosic particulate filler with an aqueous dispersion of starch, b) mixing the aqueous dispersion of starch-contacted filler with papermaking fibers, thereby forming a filler-containing aqueous papermaking furnish comprising starch-contacted filler and papermaking fibers, c) contacting said aqueous papermaking furnish with an aqueous dispersion of a flocculant, d) providing at least one additional papermaking furnish, e) directing said papermaking furnishes onto foraminous papermaking clothing; thereby forming an embryonic multi-layered paper web from the filler-containing aqueous papermaking furnish and the additional papermaking furnish in a manner to create a multi-layered paper web wherein at least one layer is formed from the filler-containing aqueous papermaking furnish and at least one layer is formed from said additional papermaking furnish, f) removing water from said multi-layered embryonic web to form a semi-dry multi-layered papermaking web, g) adhering the semi-dry multi-layered papermaking web to a Yankee dryer and drying said multi-layered web to a substantially dry condition, h) creping the substantially dry multi-layered web from the Yankee dryer by means of a flexible creping blade, thereby forming a multi-layered creped tissue paper, wherein said particulate filler comprises from about 1% to about 50% of the total weight of said creped tissue paper, said particulate filler selected from the group consisting of clay, calcium carbonate, titanium dioxide, talc, aluminum silicate, calcium silicate, alumina trihydrate, activated carbon, calcium sulfate, glass microspheres, diatomaceous earth, and mixtures thereof; and wherein said starch comprises from about 0.01% to about 5% by weight based on the weight of said particulate filler.

14. The process of claim 13 wherein the papermaking fibers of step (b) contains at least about 80% by weight of hardwood fibers, and the papermaking fibers comprising said additional papermaking furnish of step (d) contains at least about 80% by weight of softwood fibers.

15. The process of claim 14 wherein the multi-layered embryonic paper web formation of step (e) comprises a three-layered tissue paper web having two outer layers and an inner layer, said inner layer being located between said two outer layers, wherein the filler-containing aqueous papermaking furnish comprises said two outer layers and said additional papermaking furnish comprises said inner layer.

16. The process of claim 15 wherein said particulate filler is kaolin clay having an average equivalent spherical diameter between about 0.5μ and about 5μ.

17. The process of claim 16 wherein said water removal step (f) comprises a pattern densified process wherein the water removal is effected while the embryonic web is supported on a drying fabric comprising an array of supports.

18. The process of claim 17 wherein said water removal is accomplished at least partially by means of thermal transfer using air forced through the web while it is in contact with said fabric.

19. The process of claim 18 wherein said starch has a degree of substitution ranging from about 0.01 to about 0.1 cationic substituent per anhydroglucose units of starch and wherein in step (a), said aqueous dispersion of particulate filler contains between about 0.1% and about 5% solids and said aqueous dispersion of starch contains between about 0.1% and about 10% solids.

20. The process of claim 19 wherein said flocculant is a cationic polyacrylamide containing from about 0.2 to about 2.5 milliequivalents of cationic substituent per gram of polyacrylamide and having a molecular weight of at least about 1,000,000.

21. The process of claim 20 comprising the additional step of refining the papermaking fibers to a freeness less than about 600 ml Canadian Standard Freeness prior to contact with said particulate filler in step (b).

22. The process of claim 2 wherein said water removal step (f) comprises a pattern densified process wherein the water removal is effected while the embryonic web is supported on a drying fabric comprising an array of supports.

* * * * *

UNITED STATES PATENT AND TRADEMARK OFFICE
CERTIFICATE OF CORRECTION

PATENT NO. : 5,672,249

DATED : September 30, 1997

INVENTOR(S) : Kenneth Douglas Vinson et al.

It is certified that error appears in the above-identified patent and that said Letters Patent is hereby corrected as shown below:

Column 3, line 10, "tom" should read -- torn --.

Column 3, line 33, "bend" should read -- bond --.

Column 3, line 50, "modem" should read -- modern --.

Column 5, line 24, "day." Should read -- clay. --.

Column 6, line 3, "Fourdfinier" should read -- Fourdrinier --.

Column 6, line 22, "Myer." Should read -- layer. --.

Column 8, line 4, "kaolinitc" should read -- kaolinite --.

Column 8, line 6, "kaolinitc" should read -- kaolinite --.

Column 8, line 13, "kaolinitc" should read -- kaolinite --.

Column 10, line 37, "mount" should read -- amount --.

Column 14, line 65, "flurry" should read -- slurry --.

Column 16, line 28, "0 616 074 Ab1," should read -- 0 616 074 A1, --.

Column 16, line 65, "Fredberg" should read -- Friedberg --.

Column 19, line 37, "suffactant," should read -- surfactant, --.

Column 19, line 45, "alkylglyeoside" should read -- alkylglycoside --.

Column 19, line 66, "Detailed Description of the Drawings" should be on a line by itself.

Column 20, line 3, "preparation," should read -- operation, --.

Column 21, line 1, "81c." should read -- 88c. --.

Column 22, line 37, "multilayered" should read -- multi-layered --.

Column 23, line 54, "avenges." should read -- averages. --.

Column 23, line 59, "avenge" should read -- average --.

UNITED STATES PATENT AND TRADEMARK OFFICE

CERTIFICATE OF CORRECTION

PATENT NO. : 5,672,249

DATED : September 30, 1997

INVENTOR(S) : Kenneth Douglas Vinson et al.

It is certified that error appears in the above-identified patent and that said Letters Patent is hereby corrected as shown below:

Column 23, line 61, "Avenge" should read -- Average --.

Column 23, line 67, "Avenge" should read -- Average --.

Column 24, line 11, "Avenge" should read -- Average --.

Column 24, line 37, "an" should read -- art --.

Column 26, line 14, "day" should read -- clay --.

Column 26, line 24, "fiat" should read -- flat --.

Column 26, line 34, "day" should read -- clay --.

Column 26, line 39, "day" should read -- clay --.

Column 27, line 47, "Convened" should read -- converted --.

Column 30, line 24, "dally" should read -- daily --.

Column 31, line 39, "Off-Yankee" should read -- off-Yankee --.

Column 31, line 60, "#F402OM-88." Should read -- #T402OM-88. --.

Column 32, line 27, "1." Should read -- 2. --.

Column 33, line 13, "M12nd" should read -- M1 2$^{nd}$ --.

Column 33, line 43, "STRENGTH" should read -- STRENGTH: --.

Column 33, line 45, "H" -- II --.

Column 33, line 53, "#F402OM-88." should read -- #T402OM-88 --.

Column 36, line 41, "convened" should read -- converted --.

Column 36, line 58, "predispersed" should read -- pre-dispersed --.

Column 37, line 32, "chamber:" should read -- chamber --.

Column 37, line 44, after "knuckle" insert -- area. --.

UNITED STATES PATENT AND TRADEMARK OFFICE
CERTIFICATE OF CORRECTION

PATENT NO. : 5,672,249

DATED : September 30, 1997

INVENTOR(S) : Kenneth Douglas Vinson et al.

It is certified that error appears in the above-identified patent and that said Letters Patent is hereby corrected as shown below:

Column 39, line 18, "kaoline" should read -- kaolin --.

Column 40, line 8, "contains" should read -- contain --.

Column 40, line 10, "contains" should read -- contain --.

Column 40, line 49, "claim 2" should read -- claim 21 --.

Signed and Sealed this

Twenty-eighth Day of September, 1999

*Attest:*

Q. TODD DICKINSON

*Attesting Officer*

*Acting Commissioner of Patents and Trademarks*